US011408427B2

(12) United States Patent
Webster et al.

(10) Patent No.: US 11,408,427 B2
(45) Date of Patent: Aug. 9, 2022

(54) ELECTRIC SUBMERSIBLE PUMP ECCENTRIC INVERTED SHROUD ASSEMBLY

(71) Applicant: Halliburton Energy Services, Inc., Houston, TX (US)

(72) Inventors: Joshua Wayne Webster, Sand Springs, OK (US); Wesley John Nowitzki, Tulsa, OK (US); Jason Eugene Hill, Bristow, OK (US); Steven Andrew Lovell, Tulsa, OK (US); Casey Laine Newport, Tulsa, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 411 days.

(21) Appl. No.: 16/702,086

(22) Filed: Dec. 3, 2019

(65) Prior Publication Data

US 2021/0164475 A1 Jun. 3, 2021

(51) Int. Cl.

| | |
|---|---|
| ***F04D 13/10*** | (2006.01) |
| ***F04D 1/00*** | (2006.01) |
| ***E21B 43/12*** | (2006.01) |

(52) U.S. Cl.

CPC ..... *F04D 13/10* (2013.01); *E21B 43/128* (2013.01); *F04D 1/00* (2013.01)

(58) Field of Classification Search

CPC ..... F04D 13/10; F04D 1/00; F04D 13/021; E21B 43/128

See application file for complete search history.

(56) References Cited

U.S. PATENT DOCUMENTS

| | | | | |
|---|---|---|---|---|
| 7,766,081 | B2 * | 8/2010 | Brown | E21B 43/38 96/217 |
| 8,955,598 | B2 * | 2/2015 | Brown | E21B 43/38 417/424.2 |
| 9,638,015 | B2 | 5/2017 | Nowitzki et al. | |
| 2009/0065202 | A1 | 3/2009 | Brown et al. | |
| 2009/0266561 | A1 | 10/2009 | Cobb | |
| 2014/0000345 | A1 * | 1/2014 | Wilson | G01D 5/35316 96/216 |
| 2015/0053414 | A1 | 2/2015 | Reid | |

(Continued)

OTHER PUBLICATIONS

Foreign Communication from Related Application—International Search Report and Written Opinion of the Internationa Searching Authority, International Application No. PCT/US2019/065162, dated Aug. 28, 2020, 13 pages.

*Primary Examiner* — Michael R Wills, III

(74) *Attorney, Agent, or Firm* — Conley Rose, P.C.; Rodney B. Carroll

(57) ABSTRACT

An electric submersible pump (ESP) assembly. The ESP assembly comprises an inverted shroud separating a centrifugal ESP pump from a well casing, the ESP pump rotatably coupled to an ESP motor, the inverted shroud having an opening on an upstream terminal side, the upstream terminal side terminating at a head of the ESP motor, at least a portion of the ESP motor extending through the opening, the portion of the ESP motor extending through the opening exposed to formation fluid, and the opening sealed to the formation fluid at the head of the ESP motor tapered and wedged to the inverted shroud, wherein a centerline of the inverted shroud is offset from a centerline of the ESP motor.

20 Claims, 21 Drawing Sheets

(56) References Cited

U.S. PATENT DOCUMENTS

| | | | | |
|---|---|---|---|---|
| 2016/0024860 | A1* | 1/2016 | Semple | E21B 43/128<br>166/105 |
| 2016/0130923 | A1 | 5/2016 | Nowitzki et al. | |
| 2018/0274344 | A1 | 9/2018 | Ejim et al. | |
| 2019/0309768 | A1* | 10/2019 | Todd | E21B 43/38 |

* cited by examiner 195
185
220
140
105
625
600
605
640
170
635
630
145
630
100
130
150
125
610
120
220
155
190
160
115
165
110
620

ELECTRIC SUBMERSIBLE PUMP ECCENTRIC INVERTED SHROUD ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Submersible pump assemblies are used to artificially lift fluid to the surface in deep wells such as oil or water wells. A typical vertical electric submersible pump (ESP) assembly consists of, from bottom to top, an electric motor, a pump intake, and a centrifugal pump, which are all connected together with shafts. The electric motor supplies torque to the shafts, which provides power to the centrifugal pump. The electric motor is generally connected to a power source located at the surface of the well using a motor lead extension. The entire assembly is placed into the well inside a well casing. In a cased completion, the well casing separates the submersible pump assembly from the surrounding formation. Perforations in the well casing allow well fluid to enter the well casing. These perforations are generally below the motor, and fluid flow from the perforations may be advantageous for cooling the motor when the pump is in operation, since fluid may be drawn past the outside of the motor as it makes it way from the perforations up to the pump intake.

One challenge to economic and efficient ESP operation is pumping gas laden fluid. When pumping gas laden fluid, the gas may separate from the other fluid due to the pressure differential created when the pump is in operation. If there is a sufficiently high gas volume fraction, typically about 10% or more, the pump may experience a decrease in efficiency and decrease in capacity or head (slipping). If gas continues to accumulate on the suction side of the impeller it may entirely block the passage of other fluid through the centrifugal pump. When this occurs the pump is said to be "gas locked" since proper operation of the pump is impeded by the accumulation of gas. As a result, careful attention to gas management in submersible pump systems is needed in order to improve the production of gas laden fluid from subsurface formations.

Currently in wells with gas laden fluid, and particularly in low liquid volume, high gas wells (typically 200-500 bpd of liquid (31,800-79,490 liters per day) and 700-1000 MCF/d of gas (19,824,000-28,320,000 cubic meters per day)), a conventional inverted shroud is sometimes employed. In such instances, a shroud is placed around the ESP motor, enclosing the motor within the shroud, and including tubing that extends upwards towards the pump base. The bottom of the shroud around the motor is closed, creating a barrier to well fluid. The top of the shroud is open above the pump intake. During operation in a cased completion, fluid from the surrounding formation enters perforations in the well casing located below the motor. The well fluid travels upwards in between the shroud and well casing. At the top of the shroud, the fluid makes a turn, reverses flow direction, and travels down the inside of the shroud, between the shroud and the pump assembly, and into the pump intake. From the pump intake, the fluid enters the pump and is carried through production tubing to the surface. As the fluid makes its turn at the top of the shroud, a portion of the gas breaks out of the laden fluid prior to entry into the pump, and naturally rises to the surface. The liquid travels downwards towards the intake, thereby reducing the risk of the pump becoming gas locked and promoting increased pump efficiency.

A drawback to the use of conventional inverted shrouds is that, since the motor is inside the shroud, well fluid bypasses the motor in its path through the pump assembly. Without cooling well fluid flowing around the motor, the motor risks overheating or failure due to the lack of cool, fresh flowing fluid passing by. One approach to cooling the motor in ESP assemblies making use of inverted shrouds is a recirculation pump located within the shroud. The problem with recirculation pumps is that they require a thin-walled and fragile recirculation tube. This recirculation tube is easily pinched or broken. The fragile nature of the recirculation tube may entail a very careful and slow installation process. If the recirculation pump fails, the motor may overheat, leading to failure. In addition, recirculation pumps increase ESP assembly costs since they are an additional pump that is added into the ESP assembly.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
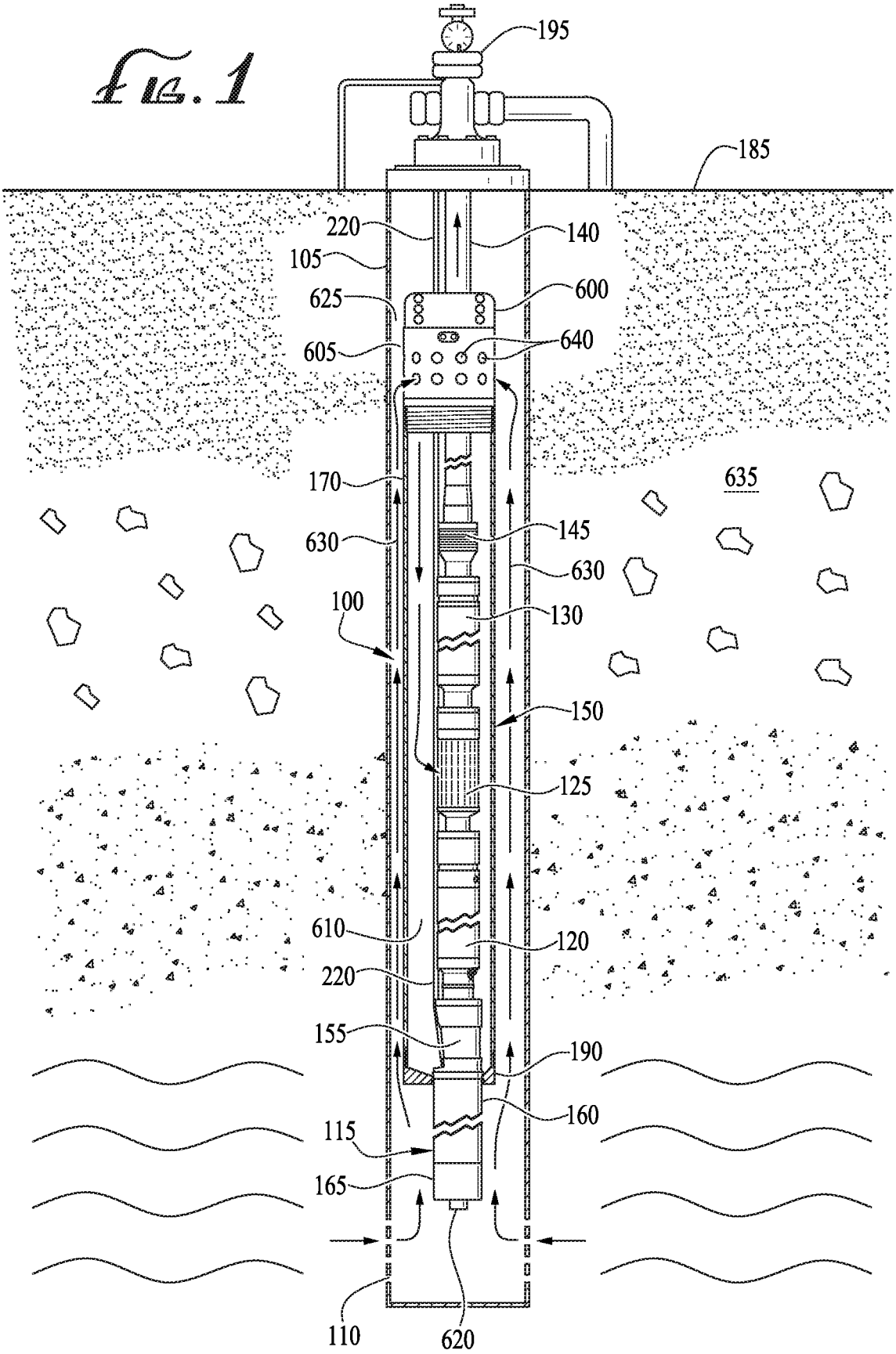
FIG. 1 is an illustration of an exemplary submersible pump assembly with an inverted shroud of illustrative embodiments and illustrating an exemplary formation fluid flow path.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Small diameter wellbores may be associated with reduced costs of drilling a wellbore and producing hydrocarbons to the surface via the wellbore. Smaller diameter drill bits may be used which cost less money. Since smaller diameter wellbores are created, less material is removed from the wellbore during drilling, and drilling can proceed more rapidly, reducing costs. The materials cost associated with deploying well casing and cementing of the casing in a completed wellbore may be less expensive as smaller diameter well casing is run into the wellbore and less volume of cement is needed to secure the well casing string in the wellbore. Thus, there may be strong incentives to using smaller diameter wellbores. A smaller diameter wellbore, however, may place aggressive physical constraints on portions of the completion system. For example, an electric submersible pump (ESP) with an inverted shroud assembly may not fit in the smaller diameter wellbore. The inverted shroud portion may be redesigned to be made from smaller diameter well casing material, but reduction of the inverted shroud diameter may not leave sufficient room for all the components of the ESP, for example the motor lead extension (MLE). A need exists, therefore, to combine a small diameter inverted shroud with an ESP while accommodating the motor lead extension within the inverted shroud.

Illustrative embodiments described herein provide an eccentrically disposed improved inverted shroud assembly that allows cooling well fluid, which enters the well casing through perforations upstream of the ESP motor, to flow past the motor before being diverted to the outer diameter of the shroud, between the shroud and the well casing, and up towards the production tubing. As used herein, the term eccentric refers to not having the same centers. In these embodiments, a centerline of the inverted shroud is offset from, while remaining substantially parallel to, a centerline of the ESP motor and the pump. The eccentrically disposed inverted shroud assembly (e.g., the inverted shroud assembly disposed so there is an offset between the centerline of the inverted shroud and the centerline of the ESP motor and pump) results in the inverted shroud assembly being shifted to one side of the ESP motor and pump, providing sufficient space inside the small diameter inverted shroud to accommodate a motor lead extension (MLE), for example when a small diameter inverted shroud is desirable for use in a small diameter wellbore casing environment or "slimline" environment. While a specific embodiment is described below, it is contemplated that a variety of alternative embodiments may advantageously apply the teachings of this disclosure to dispose the inverted shroud assembly to have its centerline offset from the centerline of the ESP motor and pump.

The shroud may be a shroud string up to two hundred feet in length or longer. The top of the shroud may be secured to the production tubing with a clamp, which may allow for the shroud to have an increased length as compared to conventional inverted shrouds. As the well fluid reaches a shroud inlet member just below the clamp, the well fluid may pass through apertures in the shroud inlet member to the inside of the shroud and flow downwards in the annular clearance between the shroud and the pump assembly, towards the ESP intake. As the well fluid flows downward inside the shroud, gas trapped in the well fluid may break out of the fluid, such that fluid entering the pump intake exhibits a reduced gas to liquid ratio (GLR) as compared to well fluid found inside the wellbore before entering the interior of the shroud via the shroud inlet, thereby reducing the risk of the pump becoming gas locked and promoting increased efficiency of the pump.

As used herein, orientation terms "upstream," "downstream," "up," and "down" are defined relative to the direction on flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Illustrative embodiments may include a motor that protrudes outside and/or upstream of the upstream end of the inverted shroud to allow well fluid to cool the motor as it passes by the motor. The motor may be attached to a motor head. A motor seat plate may be attached to an upstream terminus of the inverted shroud. In embodiments, the motor head and the motor seat plate are machined with complementary eccentric tapered surfaces: the motor head is machined with an eccentric tapered exterior surface, and the motor seat plate is machined with an eccentric tapered interior surface. When the motor is aligned with and extended through an opening in the motor seat plate, these complementary eccentric tapered surfaces form a crush seal between the motor seat plate and the motor head. The complementary eccentric tapers of the motor head and the motor seat plate at the base of the shroud may result in shifting the centerline of the inverted shroud to be off the centerline of the ESP motor and pump (or offsetting the centerline of the inverted shroud from the centerline of the ESP motor and pump), thereby providing space to accommodate the motor lead extension within the small diameter inverted shroud. The centerlines may be offset more than about 0.06 inches and less than about 1 inch (more than about 0.152 centimeters and less than about 2.54 centimeters). The centerlines may be offset more than about 0.08 inches and less than about 0.5 inches (more than about 0.203 centimeters and less than about 1.27 centimeters). The clamp securing the top of the inverted shroud to the production tubing may be eccentric so as to shift the centerline of the inverted shroud (e.g., the inverted shroud proximate to the shroud inlet) to be off the centerline of the ESP motor and pump a distance and in a direction corresponding to the shift induced by the eccentric tapers of the motor head and base of the shroud. For example a centerline of an outside diameter of the clamp that mates with an outside of the inverted shroud is offset from a centerline of a through-hole defined by the clamp that receives and grips the outside of the production tubing, where the centerline of the through-hole of the clamp is coincident with the centerline of the EPS motor and pump as well as the centerline of the production tubing.

Well fluid flowing past the portion of the motor outside of the inverted shroud (such as the portion of the motor including motor bearings and/or motor windings) may not pass through the seal formed by seating the motor head into the motor seat plate at the end of the inverted shroud, and instead after passing by the motor may be diverted around the outside of the inverted shroud, between the inverted shroud and the well casing. It is noted that an imperfect seal may not seriously degrade the performance of the ESP eccentric inverted shroud assembly taught herein. Serious performance degradation may be caused by leakage of sufficient gas to cause pump gas lock and/or degraded ESP pump efficiency, and minor leakage may not be sufficient to cause pump gas lock or to significantly degrade pump efficiency.

Illustrative embodiments allow an inverted shroud to be employed in downhole slimline (e.g., narrow wellbore environment) ESP applications without the need for an expensive and unreliable recirculation pump and without the complicated head adapters and flimsy piping common to recirculation pump designs. Illustrative embodiments provide a low cost gas separation process that may reduce gas entering the pump in high GLR environments. An inverted shroud of increased length may also be employed to maximize fluid column height above the intake, which may override large gas slugs that may undesirably cause conventional ESP systems to continuously cycle or prematurely fail.

FIG. 1 is an illustration of an electric submersible pump (ESP) assembly 100 with an eccentric inverted shroud in accordance with embodiments of the disclosure. ESP assembly 100 may be vertical or angled downhole in a well. For example, the well may be an oil well, water well, and/or well containing other hydrocarbons, such as natural gas, and/or another production fluid. The ESP assemblies 100 as described herein may be used in cased or uncased wellbores (e.g., open hole completion such as a gravel pack completion). For example in a cased completion, ESP assembly 100 may be separated from well formation 635 by well casing 105. In an exemplary embodiment, well casing 105 may be from about 6¼ inches in diameter to about 4 inches in diameter, alternatively about 5½ inches in diameter (about 14 centimeters in diameter). This may be referred to as slimline well casing or a slimline wellbore in some contexts.

Formation fluid 630 (which may also be referred to as production fluid or working fluid) may enter well casing 105 through perforations 110, which may be upstream of motor 115 of ESP assembly 100. Downstream of motor 115 may be motor protector 120, ESP intake 125, centrifugal ESP pump 130 and production tubing 140. In embodiments, the centrifugal ESP pump 130 may be a multistage centrifugal pump. Other components of ESP assemblies may also be included in ESP assembly 100, such as a charge pump or gas separator. Shafts of motor 115, motor protector 120, ESP intake 125 and centrifugal ESP pump 130 may be connected together (i.e., splined) and be rotated by shaft of motor 115. Production tubing 140 may carry formation fluid 630 towards wellhead 195 and be attached to centrifugal ESP pump 130 with bolt-on discharge 145. The wellhead 195 may be coupled to various surface production facilities such as an oil pipeline, a gas pipeline, an oil storage tank, and/or a water separator.

An annular clearance 610 is provided between an inside diameter of the shroud assembly 150 and an outside of the centrifugal ESP pump 130 and the ESP intake 125. It is noted that the annular clearance 610 is eccentric, since the cross-section (e.g., the cross-section normal to the centerline of the shroud assembly 150 and to the centerline of the centrifugal ESP pump 130 and the ESP intake 125) of the annular clearance 610 is not circularly symmetrical. The width of the annular clearance 610 is thickest at a point adjacent to a motor lead extension (MLE) 220, is thinnest at a point opposite the MLE 220, and varies progressively from thickest to thinnest between these opposite points. To exhibit the eccentricity of the annular clearance 610 in a different way, it is noted that a center of the inside diameter of the cross-section of the annular clearance 610 (defined by the outside diameter of the centrifugal ESP pump 130 and the EPS intake 125) is different from a center of the outside diameter of the cross-section of the annular clearance 610 (defined by the inside diameter of the shroud assembly 150).

Downhole sensors 620 may detect motor speed, internal motor temperature, pump discharge pressure, downhole flow rate and/or other operating conditions and communicate that information to a controller on surface 185. In an exemplary embodiment, motor 115 may be a two-pole, three-phase squirrel cage induction motor. Alternatively, in an embodiment, motor 115 may be a two-pole, three-phase permanent magnet motor (PMM). In another embodiment, motor 115 may be another type of electric motor. Motor 115 may include motor head 155 that couples motor 115 to motor protector 120, motor housing 160 that houses the operative portions of motor 115 such as motor bearings and motor stator windings, and motor base 165 which completes the motor and allows attachment and/or incorporation of downhole sensors 620. The motor protector 120 may protect the motor 115 from contamination by formation fluid 630, isolating dielectric oil of the motor 115. The motor protector 120 may allow for expansion and contraction of the dielectric oil of the motor 115. The motor protector 120 may carry an axial thrust load developed by the ESP pump 130 and relieve the motor 115 from stress associated with bearing that axial thrust load.

As shown in FIG. 1, shroud assembly 150 may include a string of shroud tubing 170, and may extend between production tubing 140 and motor head 155 and/or the downstream portion of motor 115. In one or more embodiments, the outside diameter of the shroud tubing is less than about 4.5 inches (less than about 11.4 centimeters). In an embodiment, the outside diameter of the shroud tubing may be about 4 inches (about 10.2 centimeters). The motor lead extension 220 extends into motor 115 and provides power from surface 185 to motor 115. In an embodiment, the motor lead extension 220 is a flat-type of electric cable that extends upwards from its connection to the motor 115 to connect to an ESP power cable at a connection point above a clamp 600 that secures the shroud assembly 150 to the production tubing 140. The motor lead extension 220 may be spliced or otherwise connected to the ESP power cable. The ESP cable extends upwards to the surface 185 and connects to electric power and/or electric control equipment located at the surface 185. The motor bearings and electrical windings in the stator of the motor, encased by motor housing 160, may remain unshrouded (be outside of shroud assembly 150) to benefit from the passage of cooling formation fluid 630. Shroud assembly 150 may be surrounded by well casing 105, with space 625 in between the outer diameter of shroud assembly 150 and the inner diameter of well casing 105. In one example, shroud assembly 150 may be equal to or greater than about 50, 75, 100, 125, 150, 175, or 200 feet long and less than about 6, 5.5, 5, or 4.5 inches in diameter.

Shroud base comprising a motor seat plate 190 may be threaded onto the terminal upstream end of shroud tubing 170 and/or be the terminal, upstream end of shroud assembly 150. The motor seat plate 190 may be welded to the shroud base, and the shroud base may be constructed of piping, such as casing material, and have a threaded end opposite the motor seat plate 190.

Motor seat plate 190 of shroud assembly 150, and motor head 155 may form a circumferential seal to prevent formation fluid 630 with a high GLR (such as 200-500 bpd of liquid (31,800-79,490 liters per day) and 700-1000 MCF/d of gas (19,824,000-28,320,000 cubic meters per day)) from bypassing shroud assembly 150 and proceeding directly to ESP intake 125. Motor 115 may protrude, extend through and/or at least partially extend upstream of an opening defined by the motor seat plate 190. For example, an eccentric tapered interior surface of the motor seat plate 190 may sealingly seat into or mate with a complementary eccentric tapered exterior surface of the motor head 155 as described more fully hereinafter. For example, the motor seat plate 190 and motor head 155 may form a crush seal by seating the eccentric tapered exterior surface of the motor head 155 into the complementary eccentric tapered interior surface of the motor seat plate 190 during assembly of the ESP assembly 100 at the well site during completion activities. The details of these complementary eccentric tapered surfaces are best seen in FIG. 3A, FIG. 3B, FIG. 3C, FIG. 4A, FIG. 4B, FIG. 4C, FIG. 5A, FIG. 5B, and FIG. 5C and as described further hereinafter.

FIG. 1 illustrates an exemplary passage of formation fluid through the ESP assembly 100 of illustrative embodiments. Formation fluid 630 may enter casing 105 at perforations 110 upstream of motor base 165. Formation fluid 630 may then flow past at least a portion of motor 115 and downstream through space 625 between casing 105 and shroud assembly 150. Because a seal to well fluid may be formed between shroud assembly 150 and the motor head 155 (for example a seal between the motor head 155 and the motor seat plate 190 at the end of the shroud assembly 150), formation fluid 630 may flow around the outer diameter of shroud assembly 150 through space 625, rather than directly into ESP intake 125. In the event that the seal is imperfect or fails, the ESP assembly 100 may still continue to operate since motor 115 may still be cooled by formation fluid 630 flowing by motor 115. This feature of illustrative embodiments provides an advantage over conventional recirculation pump designs, since in those conventional designs, if the recirculation pump fails, the motor temperature may rise. This may either lead to shut down of the motor 115 or failure of the motor 115 which may result in having to remove the ESP assembly 100 from the well casing 105 (i.e., pulling the pump from the wellbore).

Figure 2A:
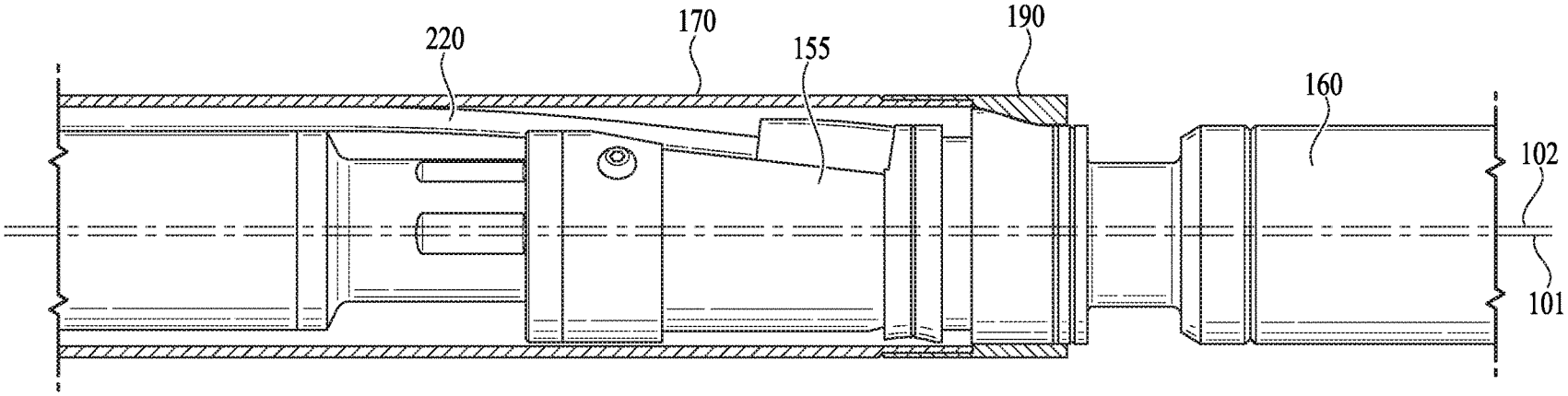
FIG. 2A is an illustration of a portion of the submersible pump assembly with the inverted shroud according to embodiments of the disclosure.
Figure 2B:
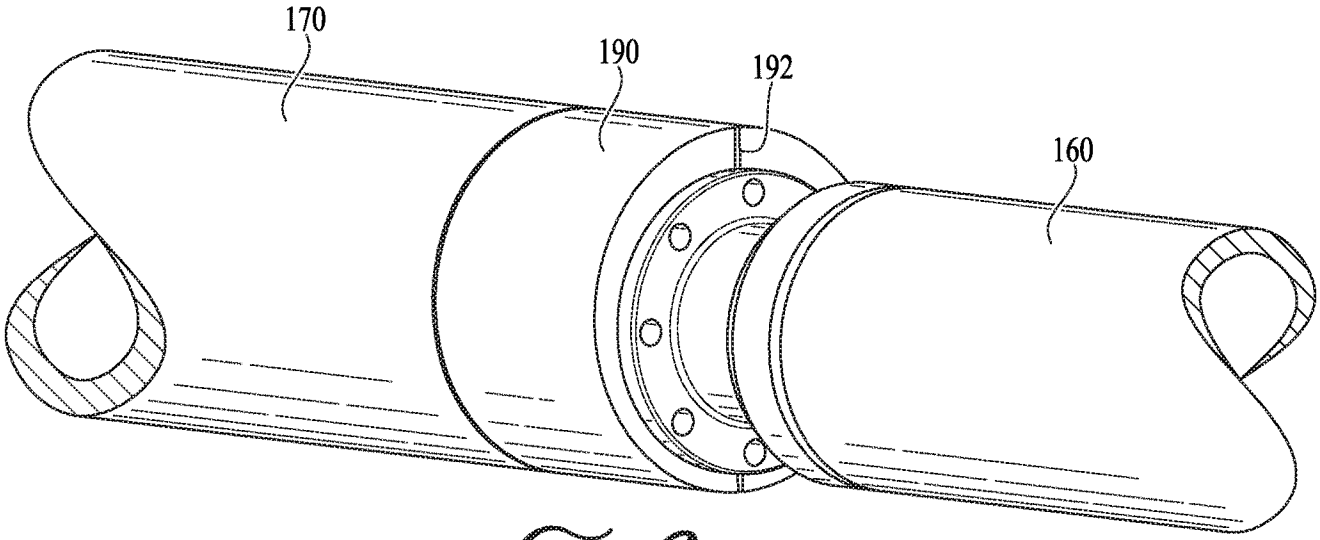
FIG. 2B is another illustration of a portion of the submersible pump assembly with the inverted shroud according to embodiments of the disclosure.

Turning now to FIG. 2A and FIG. 2B, further details of the seating of the motor head 155 in the motor seat plate 190 to form a circumferential seal are described. The motor seat plate 190 may be coupled to the terminal upstream end of shroud tubing 170, for example welded, captured with a split ring, bolted to, or otherwise attached. The motor lead extension 220 and the motor head 155 are shown within the shroud tubing 170, with a tapered exterior surface of the motor head 155 seated into a tapered interior surface of the motor seat plate 190. The motor head 155 is shown attached to the motor housing 160 that houses the motor 115. A centerline 102 of the shroud assembly 150 is illustrated as offset from a centerline 101 of the motor 115, the ESP intake 125, and the centrifugal ESP pump 130. By offsetting the centerlines 101, 102, the shroud assembly 150 may be shifted with reference to the motor 115, the ESP intake 125, and the centrifugal ESP pump 130 to make room for accommodating the motor lead extension 220 within the shroud assembly 150, for example when the shroud assembly 150 is small in diameter as in a slimline wellbore environment. In embodiments, the motor seat head 190 may define an alignment mark 192 (alternatively referred to as a reference mark, a locating mark, or a clocking mark) that indicates a maximum offset orientation. The alignment mark 192 may be used by personnel such as rig crew when building and assembling the ESP assembly 100 at a wellbore site during completion activities, for example to rotationally align motor head 155 with the motor seat plate 190.

Figure 3A:
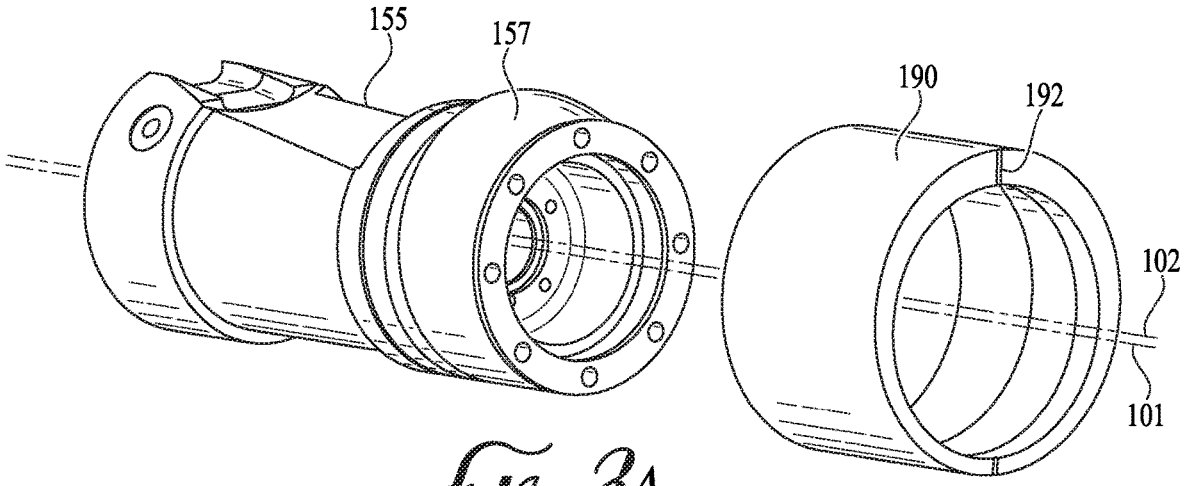
FIG. 3A is a perspective view of a motor head and a motor seat plate according to embodiments of the disclosure.
Figure 3B:
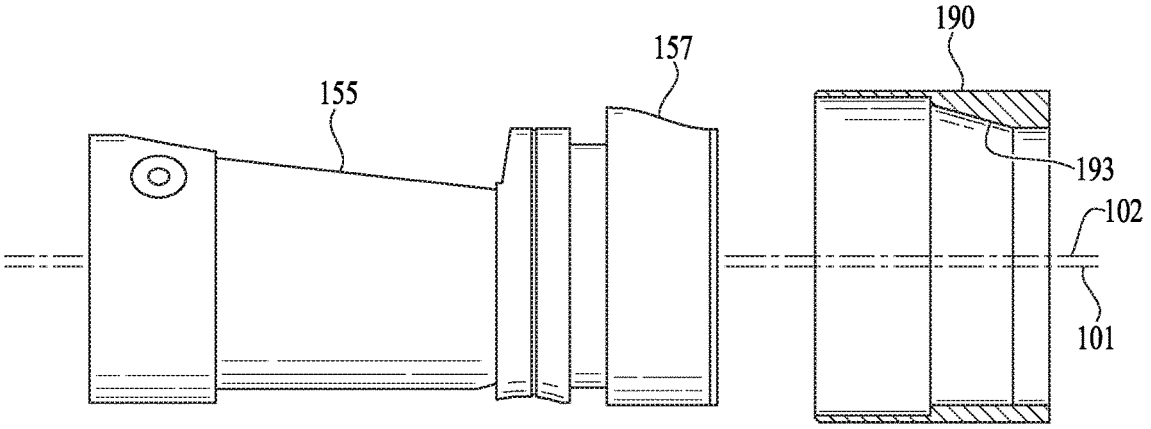
FIG. 3B is another view of the motor head and the motor seat plate according to embodiments of the disclosure.
Figure 3C:
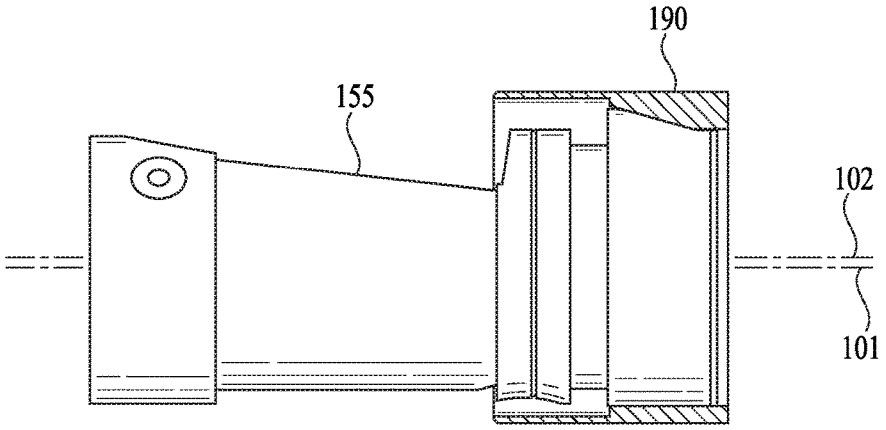
FIG. 3C is an illustration of the motor head and the motor seat plate showing a seating of a tapered exterior surface of the motor head into a tapered interior surface of the motor seat plate according to embodiments of the disclosure.

Turning now to FIG. 3A, FIG. 3B, and FIG. 3C, details of the seating of the motor head 155 in the motor seat plate 190 are discussed further. The motor head 155 defines an eccentric tapered exterior surface 157. The motor seat plate 190 defines an eccentric tapered interior surface 193 that is complementary to the eccentric tapered exterior surface 157 such that when the motor head 155 is rotationally aligned with and seats into the motor seat plate 190, the contact fit between the eccentric tapered exterior surface 157 and the eccentric tapered interior surface 193 form a circumferential seal as shown in FIG. 3C.

Figure 4A:
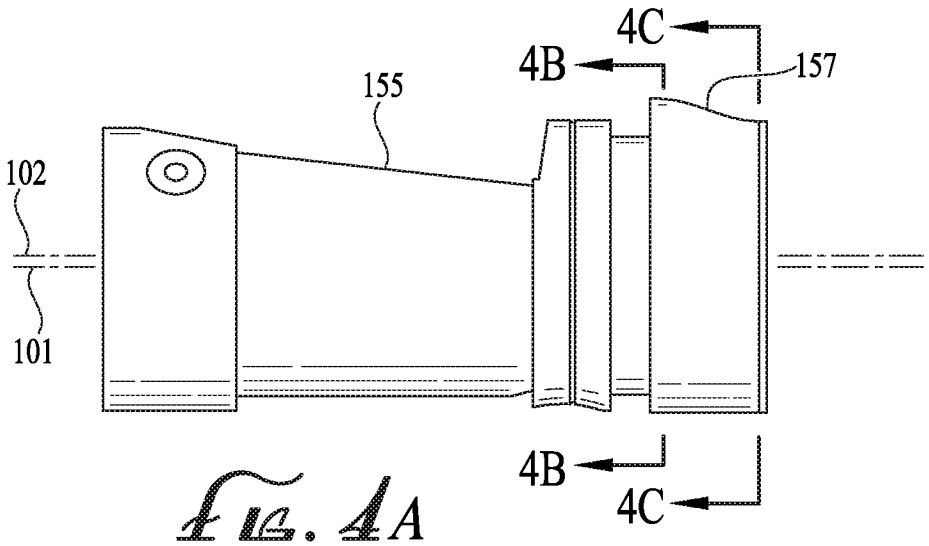
FIG. 4A, FIG. 4B, FIG. 4C, FIG. 4D, FIG. 4E, FIG. 4F, FIG. 4G, FIG. 4H, FIG. 4I, FIG. 4J, and FIG. 4K are illustrations of the motor head according to embodiments of the disclosure.
Figure 4B:
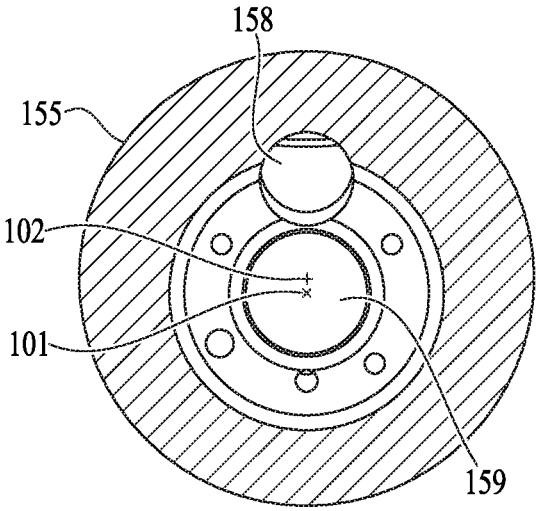
Figure 4C:
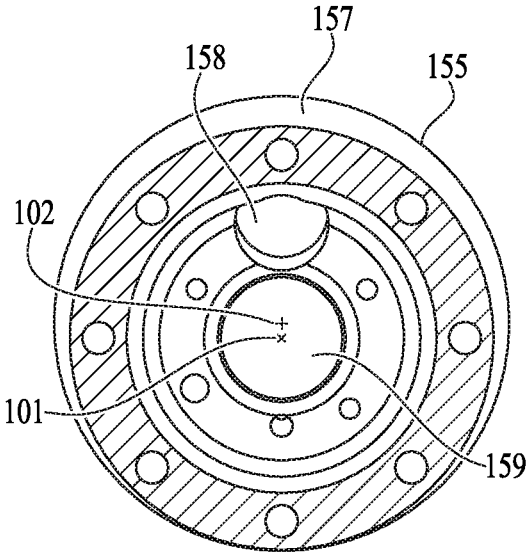

Turning now to FIG. 4A, FIG. 4B, FIG. 4C, FIG. 4D, FIG. 4E, FIG. 4F, FIG. 4G, FIG. 4H, FIG. 4I, FIG. 4J, and FIG. 4K the eccentricity of the eccentric exterior tapered surface 157 of the motor head 155 is illustrated. As best seen in FIG. 4B, an outside of the eccentric tapered exterior surface 157 at section 4B has a centerline that is coincident with the centerline 102 (i.e., the centerline 102 of the shroud assembly 150) while a first through-hole 159 defined by the motor head 155 through which a drive shaft coupling the motor 115 to the centrifugal ESP pump 130 passes has a centerline that is coincident with the centerline 101 (i.e., the centerline of the motor 115, the ESP intake 125, and the centrifugal ESP pump 130). As seen in FIG. 4C, the outside of the eccentric tapered exterior surface 157 at section 4C has a centerline that is coincident with the centerline 101. The centerlines of the eccentric tapered exterior surface 157 at section 4B and at section 4C are different and hence the eccentric tapered exterior surface 157 exhibits eccentricity.

As seen in FIG. 4D, FIG. 4E, FIG. 4F, FIG. 4G, FIG. 4H, FIG. 4I, FIG. 4J, and FIG. 4 K, the angle that the eccentric tapered exterior surface 157 makes with the centerline 101 ranges from a minimum at a first edge of the motor head 155 (the lower edge, at the 180 degrees position) to a maximum at an opposite second edge of the motor head 155 (the upper edge at the 0 degrees position), where the edge of the motor head 155 associated with the maximum angle of the eccentric tapered exterior surface 157 is aligned with a second through-hole 158 for the motor lead extension 220 to pass through to connect to the motor 115. The angle that the eccentric tapered exterior surface 157 makes with the centerline 101 is the angle made by the intersection of the surface 157 with an imaginary plane that passes through the centerline 101 and the point of interest on the surface 157, for example with the upper edge at the 0 degrees position, with the lower edge at the 180 degrees position, or at any position between the 0 degrees position and the 180 degrees position. The angle value is considered as a positive value for purposes of description.

Figure 4D:
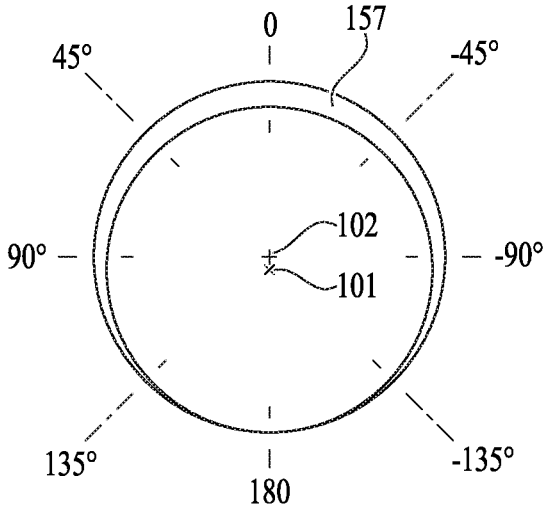
Figure 4E:
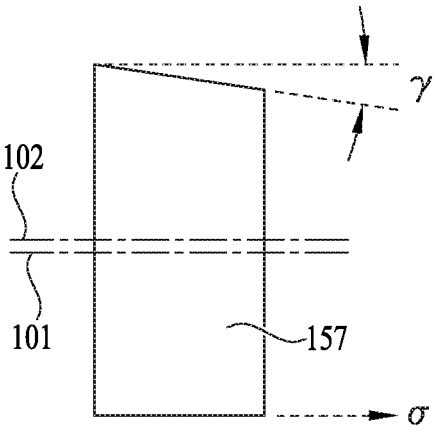

With reference to FIG. 4D and FIG. 4E. FIG. 4D is a simplified view of the section 4C and shows a 0 degree position aligned with the second through-hole 158 and a 180 degree position opposite the 0 degree position. Intermediate positions of 45 degrees, 90 degrees, 135 degrees, −45 degrees, −90 degrees, and −135 degrees are also shown. The view of the eccentric tapered exterior surface 157 shown in FIG. 4E is the view from the 90 degrees position illustrated in FIG. 4D. The top of the eccentric tapered exterior surface 157 (i.e., at the 0 degree position) makes an angle $\gamma$ to the centerline 101. The bottom of the eccentric tapered exterior surface 157 (i.e., at the 180 degree position) makes an angle $\sigma$ to the centerline 101. In an embodiment, the angle $\gamma$ is about 15 degrees and the angle $\sigma$ is about 0 degrees. The angle defined by the tapered surface 157 between the 0 degree position and the 180 degree position varies linearly with position from the maximum angle $\gamma$ to the minimum angle $\sigma$.

Figure 4F:
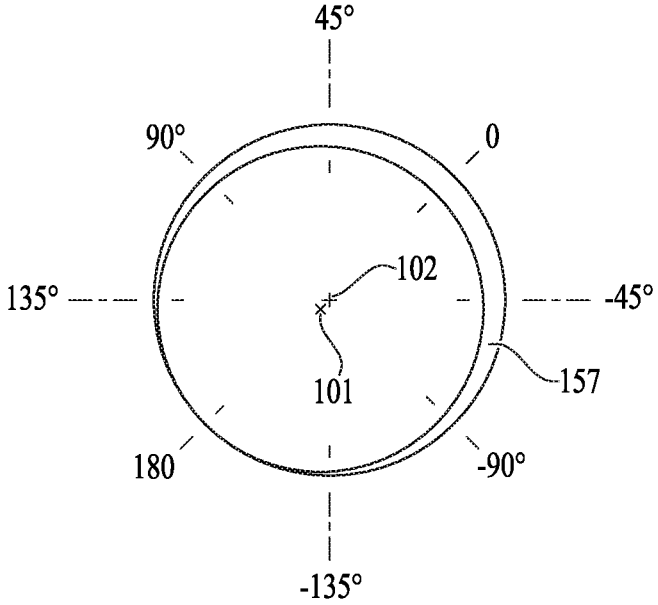
Figure 4G:
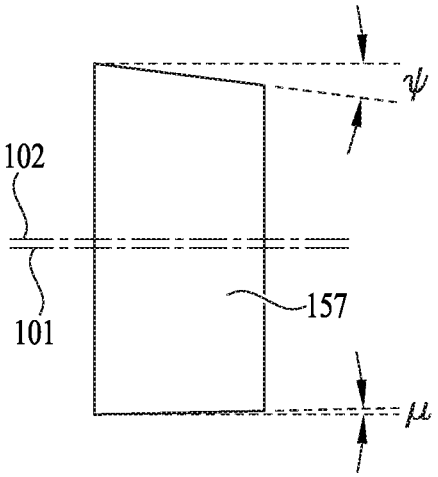

With reference to FIG. 4F and FIG. 4G. FIG. 4F is a simplified view of the section 4C and shows a 0 degree position aligned with the second through-hole 158 and a 180 degree position opposite the 0 degree position. The view of the eccentric tapered exterior surface 157 shown in FIG. 4G is the view from the 135 degrees position illustrated in FIG. 4F. The top of the eccentric tapered exterior surface 157 (i.e., at the 45 degree position) makes an angle $\psi$ to the centerline 101. The bottom of the eccentric tapered exterior surface 157 (i.e., at the −135 degrees position) makes an angle $\mu$ to the centerline 101. In an embodiment, the angle $\psi$ is about 11.25 degrees and the angle $\mu$ is about 3.75 degrees.

Figure 4H:
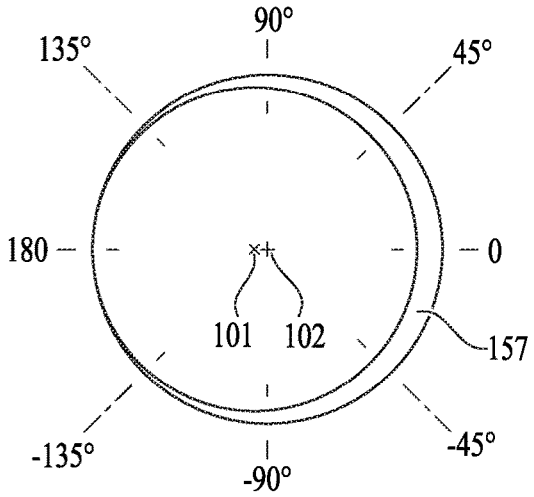
Figure 4I:
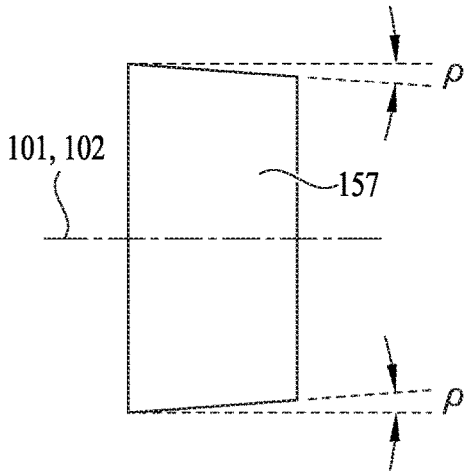

With reference to FIG. 4H and FIG. 4I. FIG. 4H is a simplified view of the section 4C and shows a 0 degree position aligned with the second through-hole 158 and a 180 degree position opposite the 0 degree position. The view of the eccentric tapered exterior surface 157 shown in FIG. 4I is the view from the 180 degrees position illustrated in FIG. 4H. The top of the eccentric tapered exterior surface 157 (i.e., at the 90 degree position) makes an angle $\rho$ to the centerline 101. The bottom of the eccentric tapered exterior surface 157 (i.e., at the −90 degrees position) makes the same angle $\rho$ to the centerline 101. In an embodiment, the angle $\rho$ is about 7.5 degrees.

Figure 4J:
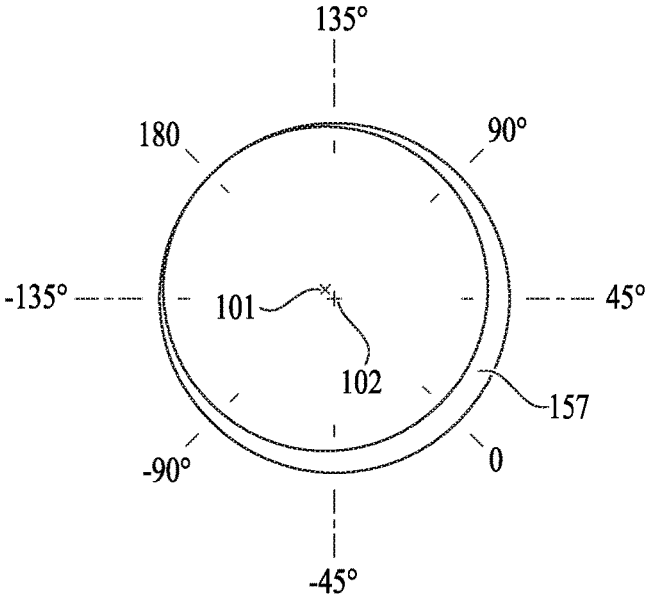
Figure 4K:
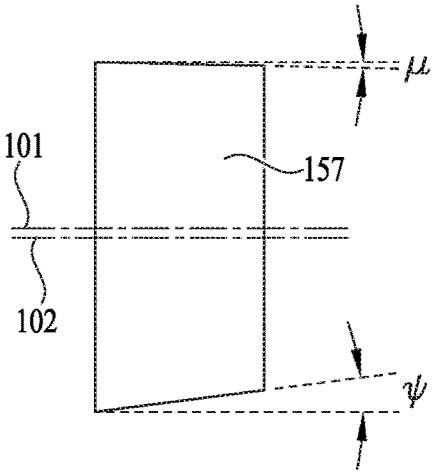

With reference to FIG. 4J and FIG. 4K. FIG. 4J is a simplified view of the section 4C and shows a 0 degree position aligned with the second through-hole 158 and a 180 degree position opposite the 0 degree position. The view of the eccentric tapered exterior surface 157 shown in FIG. 4K is the view from the −135 degrees position illustrated in FIG. 4J. The top of the eccentric tapered exterior surface 157 (i.e., at the 135 degree position) makes the angle $\mu$ to the centerline 101. The bottom of the eccentric tapered exterior surface 157 (i.e., at the −45 degrees position) makes the angle $\psi$ to the centerline 101. In an embodiment, the angle $\mu$ is about 3.75 degrees and the angle $\psi$ is about 11.25 degrees.

In an embodiment, the angle that the eccentric tapered exterior surface 157 makes with the centerline 101 (e.g., the angle defined by the intersection of a plane passing through the centerline 101 and the point on the exterior surface 157, where the angle is considered as an absolute value) varies linearly with the angular position around the eccentric tapered exterior surface 157. In an embodiment, the angle may be given as:

$$\text{Angle} = (\text{Max} - \text{Min})\frac{180 - |\text{position}|}{180} + \text{Min} \qquad \text{EQ 1}$$

where Max is the maximum angle, Min is the minimum angle, and position is the angular position around the eccentric tapered exterior surface. In the example described above, Max was given the value of about 15 degrees and Min was given the value of about 0 degrees. In another embodiment, the Max and Min may have different values, where Max is greater than Min.

Figure 5A:
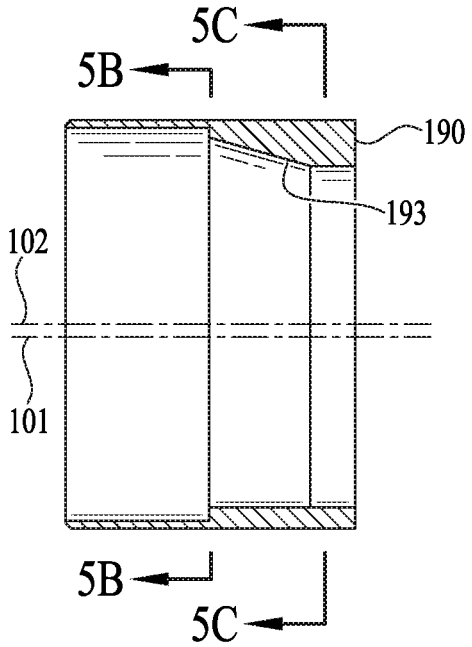
FIG. 5A, FIG. 5B, FIG. 5C, FIG. 5D, FIG. 5E, FIG. 5F, FIG. 5G, FIG. 5H, FIG. 5I, FIG. 5J, FIG. 5K, and FIG. 5L are illustrations of the motor seat plate according to embodiments of the disclosure.
Figure 5B:
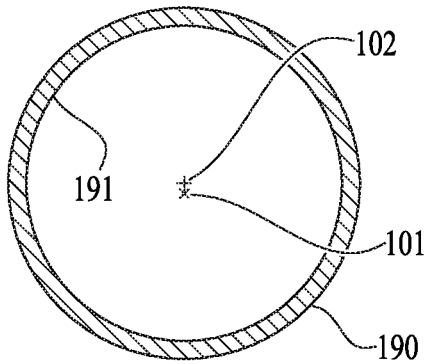
Figure 5C:
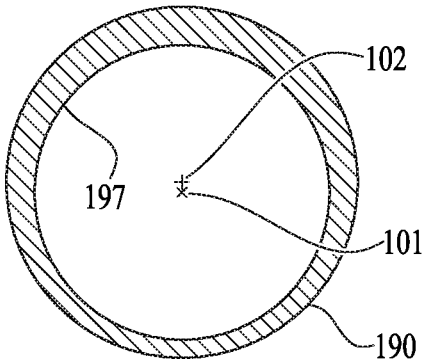

Turning now to FIG. 5A, FIG. 5B, FIG. 5C, FIG. 5D, FIG. 5E, FIG. 5F, FIG. 5G, FIG. 5H, FIG. 5I, FIG. 5J, FIG. 5K, and FIG. 5L the eccentricity of the eccentric tapered interior surface 193 of the motor seat plate 190 is illustrated. As best seen in FIG. 5C, an inside diameter 197 of the eccentric tapered interior surface 193 at section 5C has a centerline that is coincident with the centerline 101, while the outside of the motor seat plate 190 at section 5C is coincident with the centerline 102. As seen in FIG. 5B, an inside diameter 191 of the eccentric tapered interior surface 193 at section 5B has a centerline that is coincident with the centerline 102. The centerlines of the eccentric tapered interior surface 193 at section 5B and at section 5C are different and hence the eccentric tapered interior surface 193 exhibits eccentricity.

As seen in FIG. 5D, FIG. 5E, FIG. 5F, FIG. 5G, FIG. 5H, FIG. 5I, FIG. 5J, FIG. 5K, and FIG. 5L, the angle that the eccentric tapered interior surface 193 makes with the centerline 101 ranges from a minimum angle at a first edge of the motor seat plate 190 (the lower edge at 180 degrees) to a maximum angle at an opposite second edge of the motor seat plate 190 (the upper edge at 0 degrees, proximate to the alignment mark 192 described above with reference to FIG. 3A).

Figure 5D:
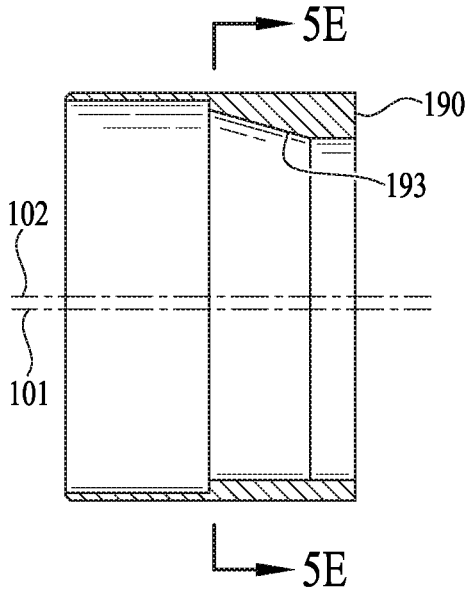
Figure 5E:
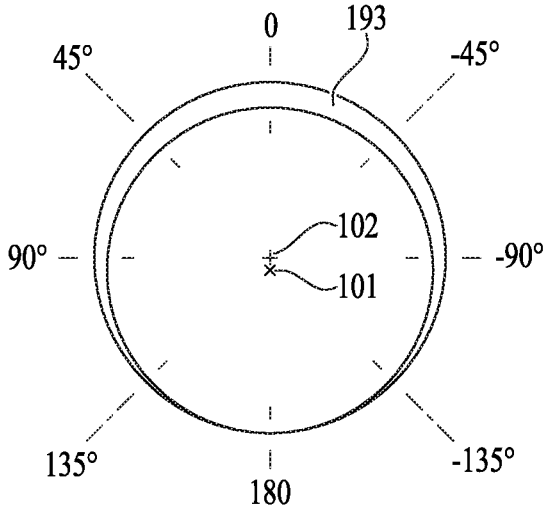
Figure 5F:
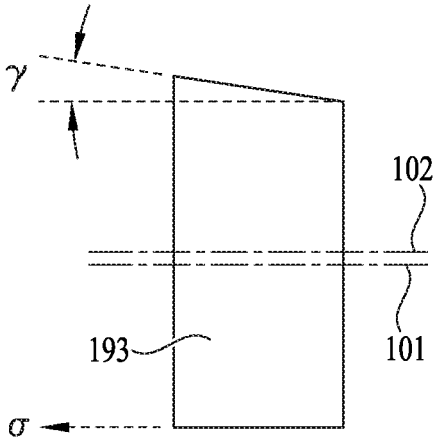

With reference to FIG. 5D, FIG. 5E, and FIG. 5F, the section 5E is shown in FIG. 5E with angular positions indicated at a 0 degree position aligned with the alignment mark 192 described above with reference to FIG. 3A, at a 180 degrees position opposite the 0 degree position, and intermediate positions of 45 degrees, 90 degrees 135 degrees, −45 degrees, −90 degrees, and −135 degrees. The view of the eccentric tapered interior surface 193 shown in FIG. 5F is the view from the −90 degrees position illustrated in FIG. 5D. The top of the eccentric tapered interior surface 193 (i.e., at the 0 degree position) makes an angle an angle $\gamma$ to the centerline 101. The bottom of the eccentric tapered interior surface 193 (i.e., at the 180 degree position) makes an angle $\sigma$ to the centerline 101. In an embodiment, the angle $\gamma$ is about 15 degrees and the angle $\sigma$ is about 0 degrees. The angle defined by the tapered surface 193 between the 0 degree position and the 180 degree position varies linearly with position from the maximum angle $\gamma$ to the minimum angle $\sigma$.

Figure 5G:
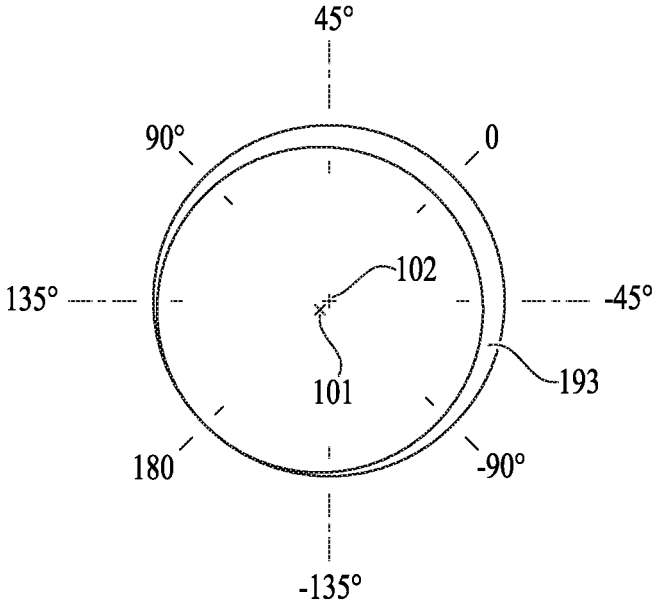
Figure 5H:
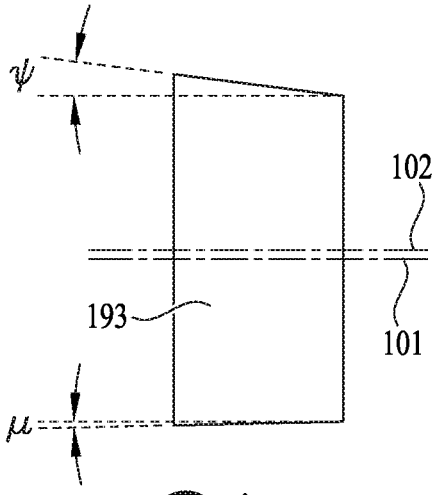

With reference to FIG. 5G and FIG. 5H. The view of the eccentric tapered exterior surface 157 shown in FIG. 5H is the view from the −45 degrees position illustrated in FIG. 5G. The top of the eccentric tapered interior surface 193 (i.e., at the 45 degree position) makes an angle ψ to the centerline 101. The bottom of the eccentric tapered exterior surface 157 (i.e., at the −135 degrees position) makes an angle μ to the centerline 101. In an embodiment, the angle ψ is about 11.25 degrees and the angle μ is about 3.75 degrees.

Figure 5I:
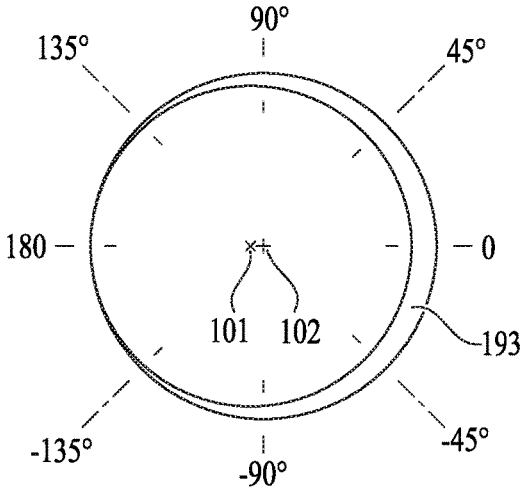
Figure 5J:
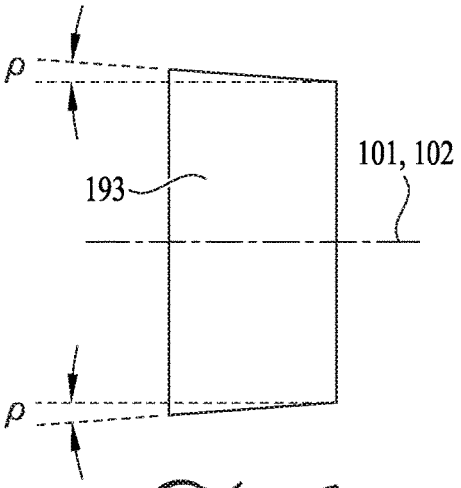

With reference to FIG. 5I and FIG. 5J. The view of the eccentric tapered interior surface 193 shown in FIG. 5J is the view from the 0 degrees position illustrated in FIG. 5I. The top of the eccentric tapered interior surface 193 (i.e., at the 90 degree position) makes an angle ρ to the centerline 101. The bottom of the eccentric tapered exterior surface 157 (i.e., at the −90 degrees position) makes the same angle ρ to the centerline 101. In an embodiment, the angle ρ is about 7.5 degrees.

Figure 5K:
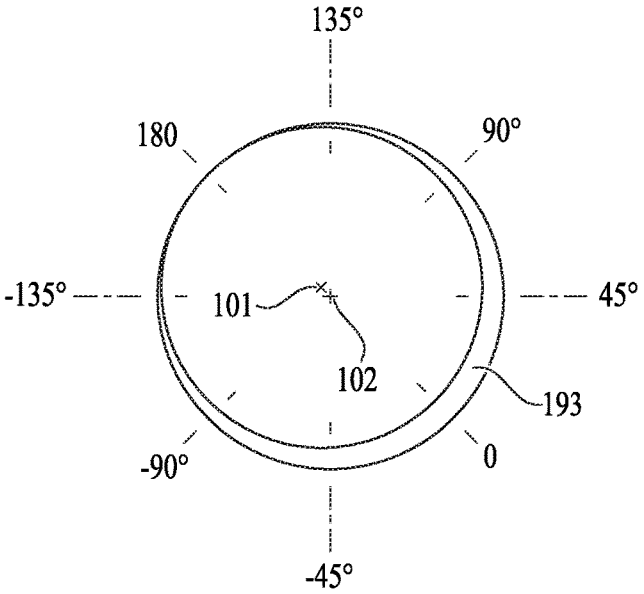
Figure 5L:
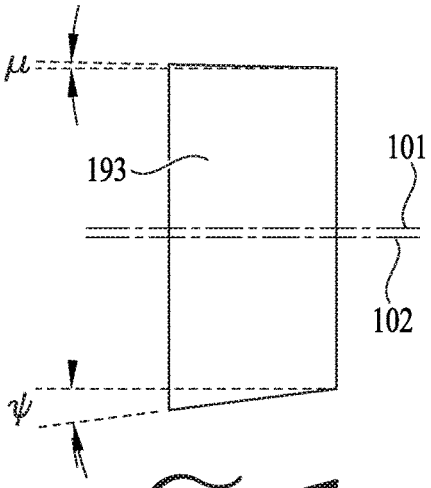

With reference to FIG. 5K and FIG. 5L. The view of the eccentric tapered interior surface 193 shown in FIG. 5L is the view from the 45 degrees position illustrated in FIG. 5K. The top of the eccentric tapered exterior surface 157 (i.e., at the 135 degree position) makes the angle μ to the centerline 101. The bottom of the eccentric tapered exterior surface 157 (i.e., at the −45 degrees position) makes the angle ψ to the centerline 101. In an embodiment, the angle μ is about 3.75 degrees and the angle ψ is about 11.25 degrees.

In an embodiment, the angle that the eccentric tapered interior surface 193 makes with the centerline 101 (e.g., the angle defined by the intersection of a plane passing through the centerline 101 and the point on the interior surface 193, where the angle is considered as an absolute value) varies linearly with the angular position around the eccentric tapered interior surface 193, according to the same relationship defined in EQ 1 above. This is the case because the eccentricity of the eccentric tapered surfaces 157 and 193 are complementary such as to provide a sealing fit when the motor head 155 is rotationally aligned with and seated into the motor seat plate 190. The motor head 155 is rotationally aligned with the motor seat plate 190 when the maximum offset of the motor head 155 coincides with the maximum offset of the motor seat plate 190. When the motor head 155 is rotationally aligned with the motor seat plate 190, the alignment mark 192 is aligned with (adjacent to) the second through-hole 158 of the motor head 155. The building of the motor head 155 and the motor seat plate 190 to provide the complementary eccentric tapered surfaces may entail machining operations that are more demanding than simple turning on a lathe, because turning on a lathe may produce rotationally symmetrical tapers but not the eccentric tapers taught herein.

Figure 6:
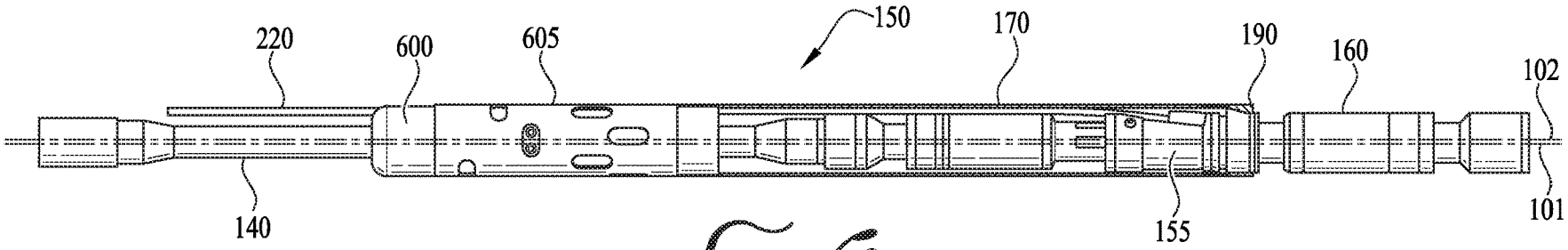
FIG. 6 is an illustration of the submersible pump assembly with the inverted shroud according to embodiments of the disclosure.

Turning now to FIG. 6, the ESP assembly 100 is illustrated. The left side of the illustration corresponds to a downstream and an uphole end of the ESP assembly 100 and the right side of the illustration corresponds to an upstream and downhole end of the ESP assembly 100. The clamp 600 couples to the shroud inlet 605 with shear keys as described further below. The clamp 600 secures the shroud assembly 150 to the production tubing 140 as described further below.

Figure 7A:
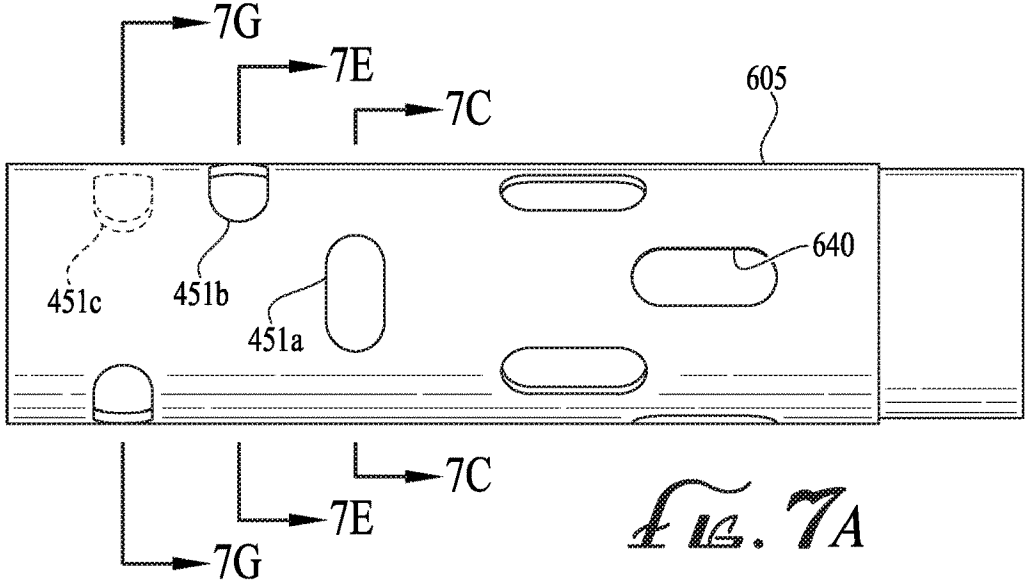
FIG. 7A, FIG. 7B, FIG. 7C, FIG. 7D, FIG. 7E, and FIG. 7G are illustrations of a shroud inlet according to embodiments of the disclosure.
Figure 7B:
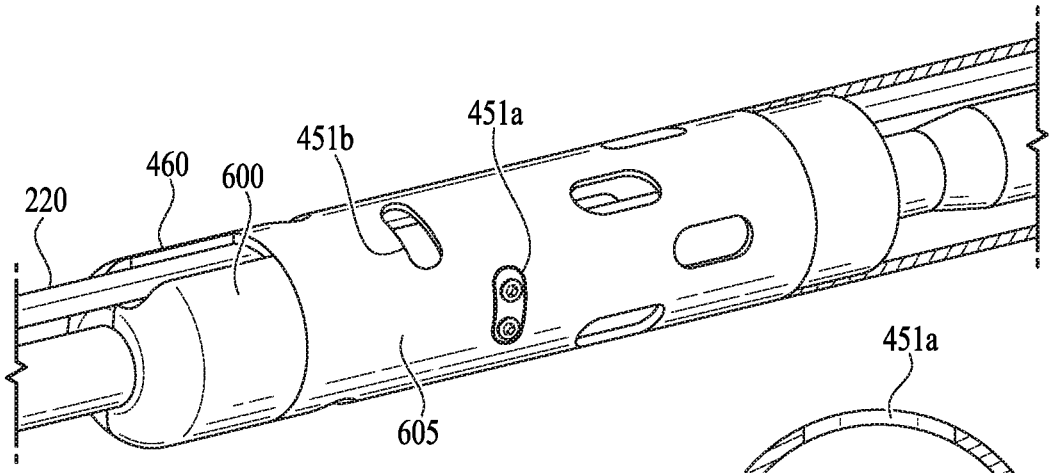
Figure 7C:
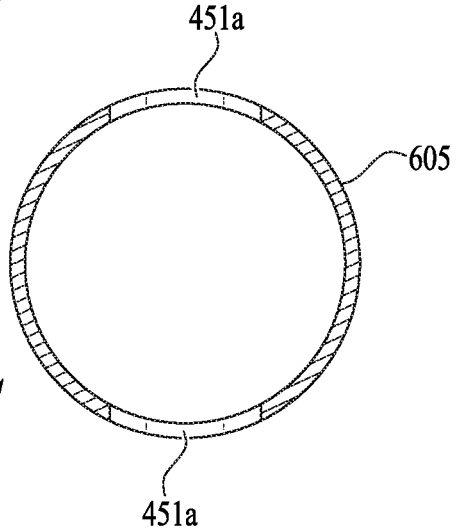
Figure 7D:
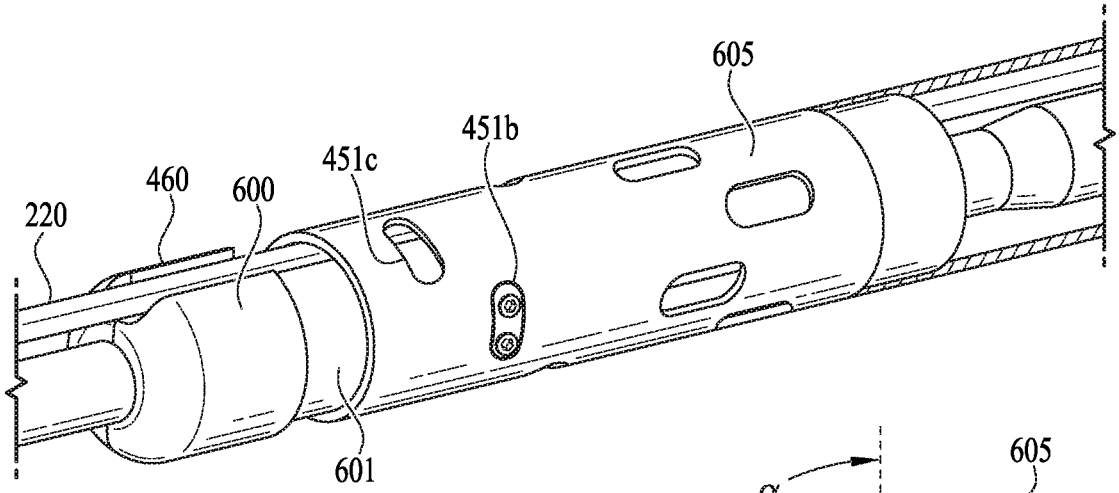
Figure 7E:
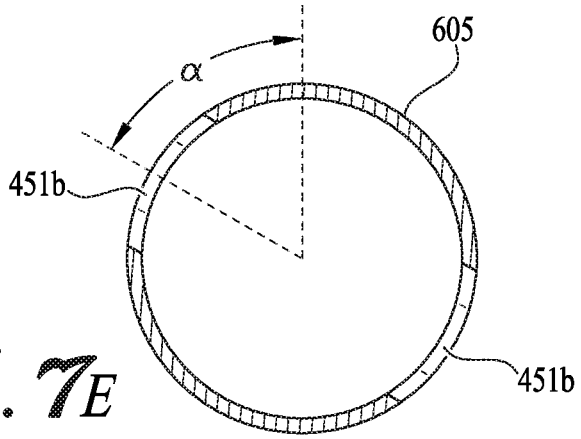
Figure 7F:
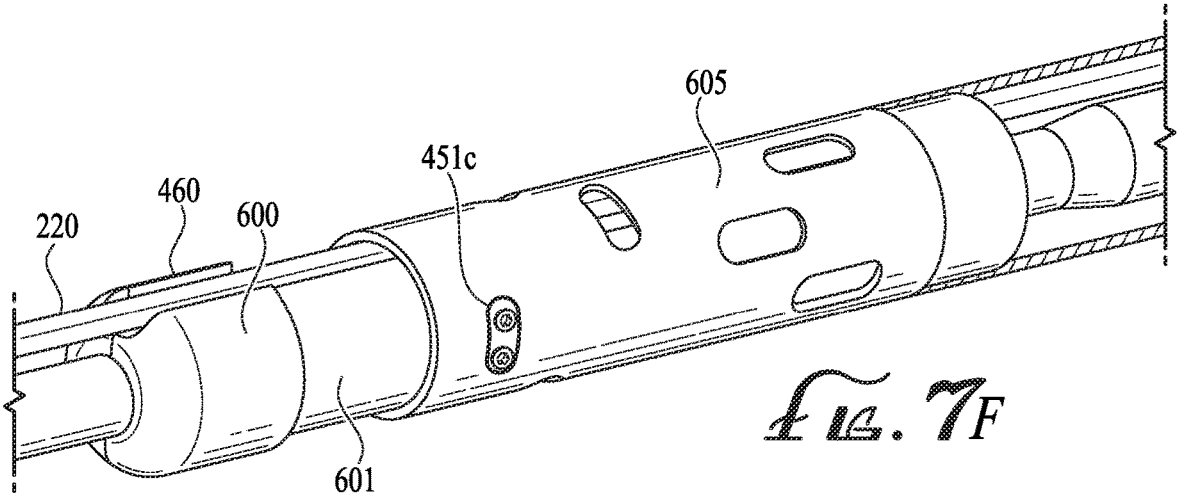
Figure 7G:
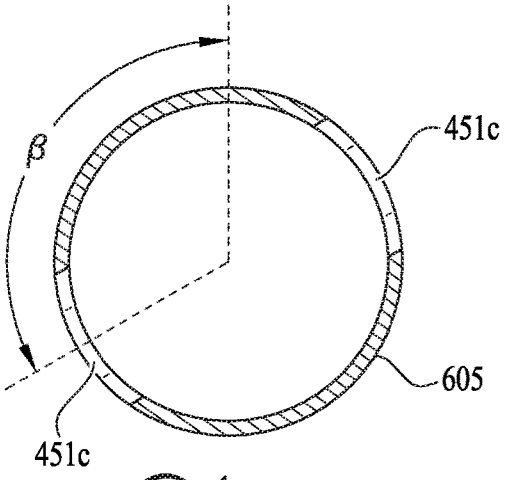

Turning now to FIG. 7A, FIG. 7B, FIG. 7C, FIG. 7D, FIG. 7E, FIG. 7F, and FIG. 7G, the coupling of the clamp 600 to the shroud inlet 605 is described. The clamp 600 defines a motor lead extension pathway 460 that provides for the motor lead extension 220 to exit at the top of the shroud assembly 150. The shroud inlet 605 defines a plurality of apertures 640 that promote flow of formation fluid from the wellbore annulus (space 625) into the interior of the shroud assembly 150 (annular clearance 610). The shroud inlet 605 further defines one or more keyway aperture pairs 451. For example, the shroud inlet 605 may define a first keyway aperture pair 451*a*, a second keyway aperture pair 451*b*, and a third keyway aperture pair 451*c*. Each keyway aperture pair 451 comprises two apertures that are located opposite each other (180 degrees angularly rotated) in the surface of the shroud inlet 605. As best seen in FIG. 7E, in embodiments, the second keyway aperture pair 451*b* may be angularly rotated an angle α relative to the first keyway aperture pair 451*a*. As best seen in FIG. 7G, in embodiments, the third keyway aperture pair 451*c* may be angularly rotated an angle β relative to the first keyway aperture pair 451*a*.

In an embodiment, the second keyway aperture pair 451*b* is located 60 degrees angularly displaced to the first keyway aperture pair 451*a* (i.e., angle α equals 60 degrees), and the third keyway aperture pair 451*c* is located 120 degree angularly displaced to the first keyway aperture pair 451*a* (i.e., angle β equals 120 degrees) and 60 degrees angularly displaced to the second keyway aperture pair 451*b*. In another embodiment, the shroud inlet 605 may define two keyway aperture pairs 451 located 90 degrees rotationally apart. In another embodiment, the shroud inlet 605 may define four keyway aperture pairs 451 located 45 degrees rotationally apart. In another embodiment, the shroud inlet 605 may define a different number of keyway aperture pairs 451 located equally angularly rotated with reference to each adjacent keyway aperture.

The keyway aperture pairs 451 are located at different distances along the longitudinal axis of the shroud inlet 605 (e.g., along centerline 102 of the shroud assembly 150). The second keyway aperture pair 451*b* is displaced longitudinally in a first direction (uphole) from the first keyway aperture pair 451*a*, and the third keyway aperture pair 451*c* is displaced longitudinally in the first direction (uphole) from the second keyway aperture pair 451*b*. The clamp 600 is coupled to the shroud inlet 605 by attaching a shear key to the clamp 600 where the shear key is captured in one of the keyway apertures 451, for example a pair of shear keys captured in one of the keyway aperture pairs 451.

A sleeve insert portion 601 of the clamp 600 inserts inside the shroud inlet 605. By aligning the motor lead extension 220 with the motor lead extension pathway 460 in the clamp 600, a space for the exit of the motor lead extension 220 from the interior of the shroud assembly 150 is provided. The sleeve insert portion 601 of the clamp 600 may then be inserted inside the shroud inlet 605 and attachment threads in the surface of the clamp 600 aligned with one of the keyway aperture pairs 451 in the shroud inlet. The clamp 600 may be rotated +/−30 degrees to align with one of the keyway aperture pairs 451 without significantly disrupting the lay of the motor lead extension 220 along the interior of the shroud assembly 150. The clamp 600 may then be coupled to the shroud inlet 605 with shear keys as described below.

Figure 8:
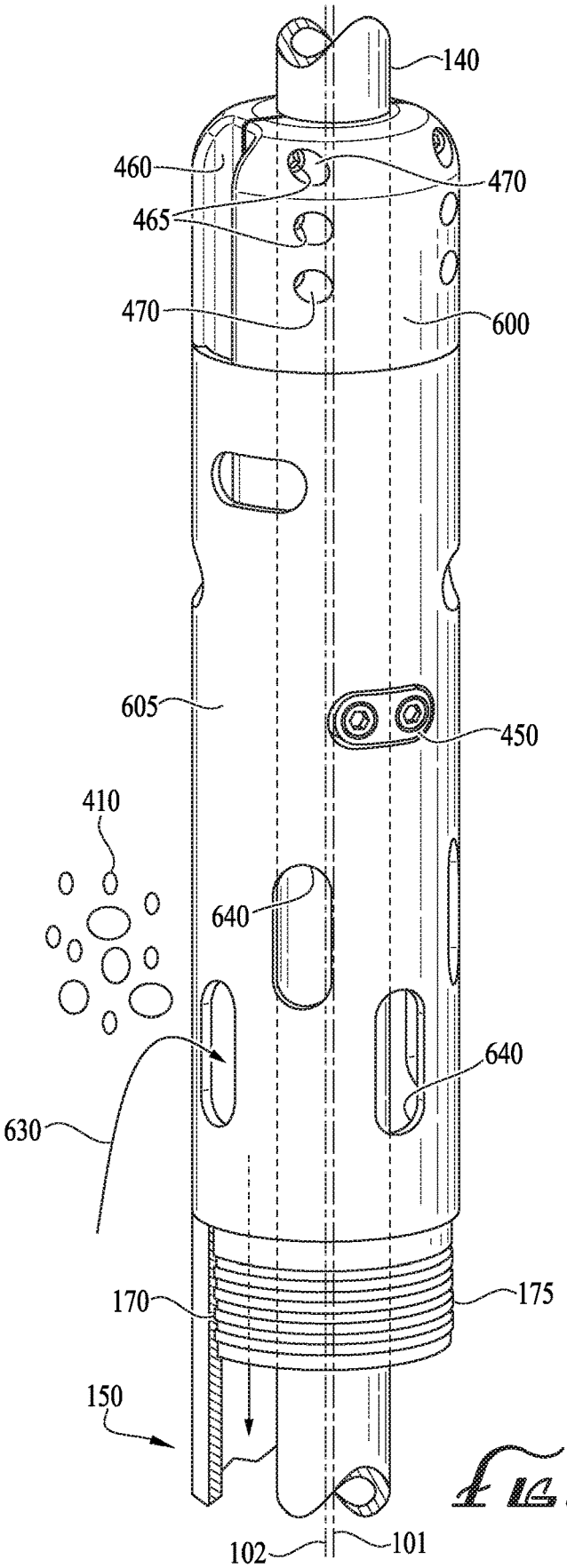
FIG. 8 is a perspective view of a shroud of an illustrative embodiment secured to production tubing according to embodiments of the disclosure.

FIG. 8 details an illustrative embodiment of shroud assembly 150 attached to production tubing 140. Shroud tubing 170 may be threaded onto shroud inlet 605 via threads 175 and extend down towards motor head 155 in a string of shroud tubing 170. Shroud tubing 170 may be placed over the production tubing 140 and moved into position before it is threaded to shroud inlet 605.

Once shroud tubing 170 is secured, clamp 600 may be installed to production tubing 140. As shown in FIG. 8, clamp 600 may be secured to shroud inlet 605 by shear key 450 captured in an aperture of a keyway aperture pair 451. Another shear key 450 may be captured in the oppositely located aperture of the keyway aperture pair 451. Clamp 600 may be two pieces, for example split at motor lead extension pathway 460, and bolted together at a given torque to assure clamp 600 friction is enough to hold shroud assembly 150 but not excessive to damage production tubing 140. Clamp 600 may be secured by bolts 465. In one example, clamp 600 may be secured by two columns and three rows of bolts 465 and washers threaded into bolt holes 470. Clamp 600 may allow motor lead extension 220 to extend down to motor 115 unimpeded. At this point the ESP assembly 100 may be lowered to be installed in the well as is well known to those of skill in the art.

Figure 9:
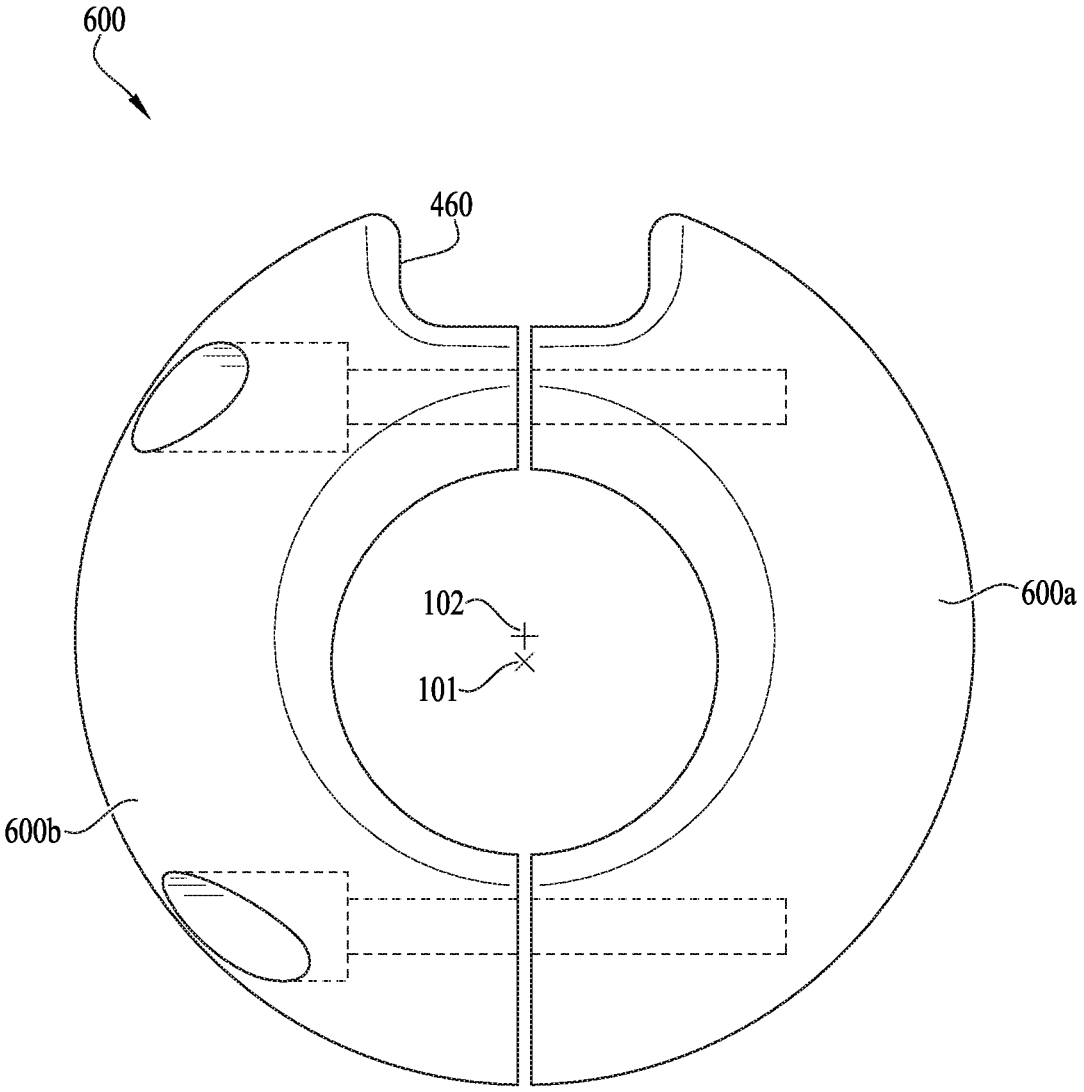
FIG. 9 is an illustration of a clamp according to embodiments of the disclosure.

Turning now to FIG. 9, further details of the clamp 600 are described. In embodiments, the clamp 600 is comprised of a first clamp portion 600*a* and a second clamp portion 600*b*. The clamp portions 600*a*, 600*b* are bolted to each other as described above with reference to FIG. 8 to secure the shroud assembly 150 to the production tubing 140. The clamp portions 600*a*, 600*b* may define the motor lead extension pathway 460 that provides for the motor lead extension 220 to pass out of the shroud assembly 150. When the clamp portions 600*a*, 600*b* are assembled as shown in FIG. 9, a centerline of the outside diameter of the clamp 600 is coincident with the centerline 102 of the shroud assembly 150, and a centerline of a through-hole defined by the clamp that receives and grips the outside of the production tubing is coincident with the centerline 101 of the ESP motor 115 and the centrifugal ESP pump 130. For this reason, the clamp 600 is said to be eccentric.

The clamp 600, the motor seat plate 190, and the motor head 155 collaborate to dispose the shroud assembly 150 eccentrically with reference to the ESP motor 115 and the centrifugal ESP pump 130. Said in other words, it is the eccentric features of the clamp 600, the eccentric features of the motor seat plate 190, and the eccentric features of the motor head 155 that cause the shroud assembly 150 to be disposed eccentrically with reference to the ESP motor 115 and the centrifugal ESP pump 130. The eccentric features of the shroud assembly 150, of the motor seat plate 190, and of the motor head 155—when the motor seat plate 190 and the shroud assembly 150 are assembled together, when the ESP motor 115, the motor head 155, the motor protector 120, the ESP intake 125, the centrifugal ESP pump 130 are assembled together and coupled to the production tubing 140, and when the ESP motor 115 is stabbed through the motor seat plate 190—cause the centerline 102 (centerline of the shroud assembly 150) to be offset from the centerline 101 (centerline of the ESP motor 115 and of the centrifugal ESP pump 130) and to maintain this offset from the upstream terminus of the shroud assembly 150 at the motor seat plate 190 to the downstream terminus of the shroud assembly 150 at the clamp 600. These eccentric features of the motor seat plate 190, the motor head 155, and the clamp 600, when the motor head 155 is properly aligned with (e.g., the alignment mark 192 is proximate to the second through hole 158 in the motor head 155) and seated into the motor seat plate 190—maintain the centerline 102 of the shroud assembly 150 approximately parallel to the centerline 101 of the ESP motor 115 and the centrifugal ESP pump 130. This offset of the centerline 102 from the centerline 101—caused by the eccentricity of the motor head 155, the eccentricity of the motor seat plate 190, and the clamp 600 when the ESP assembly 100 is assembled—provides extra space between the inside of the shroud assembly 150 and the outside of the motor head 155, the outside of the motor protector 120, the outside of the ESP intake 125, the outside of the centrifugal ESP pump 130, and the outside of the production tubing 140 to make space for the MLE 220 in a small diameter shroud assembly 150.

Figure 10:
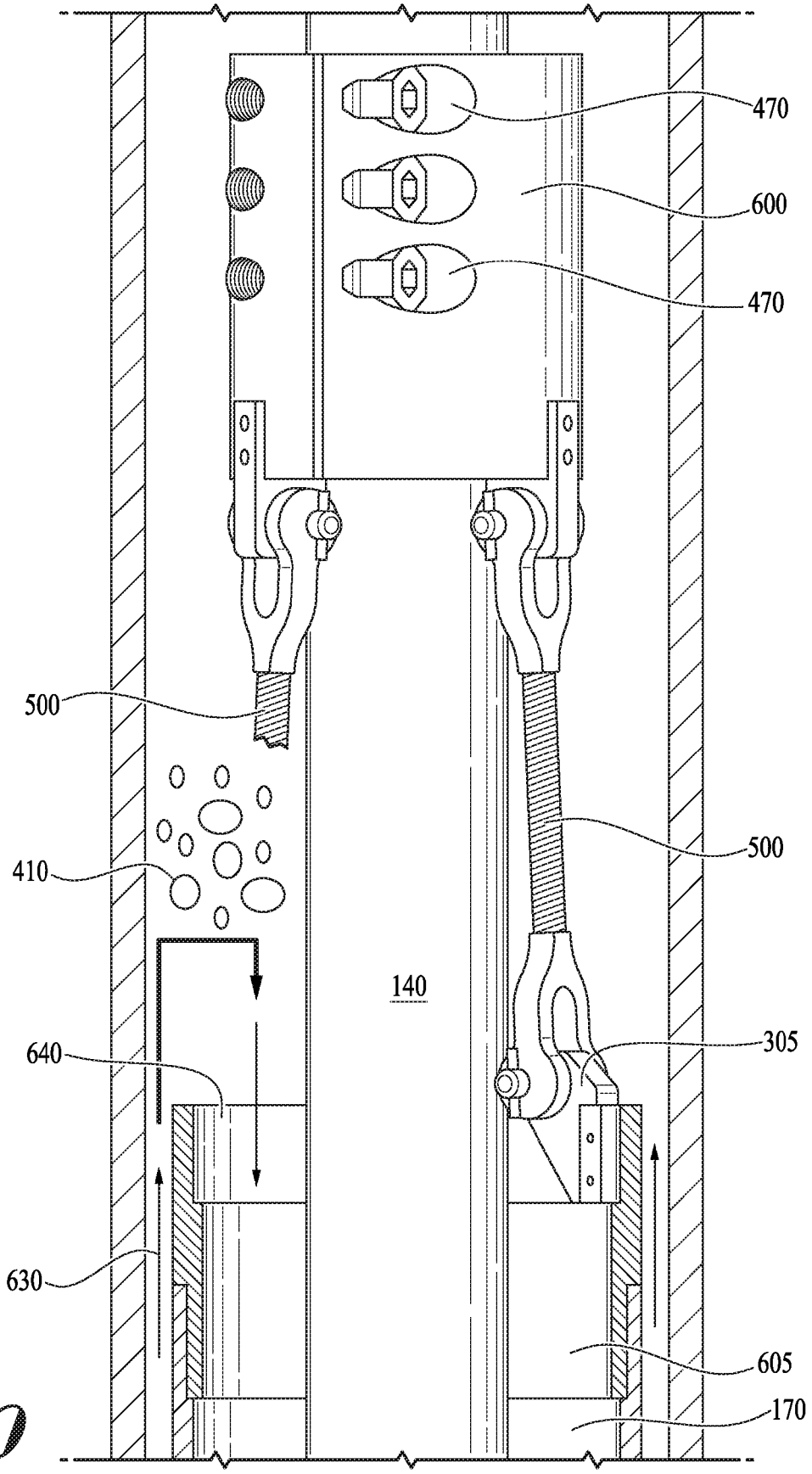
FIG. 10 is a perspective view of the shroud secured to production tubing according to embodiments of the disclosure.

FIG. 10 illustrates another illustrative embodiment of shroud assembly 150 attached to production tubing 140, with a part of a turnbuckle broken away for illustration purposes. In the embodiment shown in FIG. 10 turnbuckles 500 may couple clamp 600 to gussets 305 on shroud inlet 605. Once clamp 600 is securely in place, the turnbuckles 500 may be pinned to clamp 600. Turnbuckles 500 may then be turned to take up any slack and may be wired to prevent any turn back. In this fashion, shroud assembly 150 may surround ESP assembly 100 with annular clearance 610 in between the inner diameter of shroud assembly 150 and the outer diameter of ESP assembly 100 to allow fluid to flow around the downstream side of shroud inlet 605 and inside shroud assembly 150. In the embodiment of FIG. 10, aperture 640 is a single aperture on the downstream side of shroud inlet 605.

Inverted shroud assembly 150 may consist of internal and external threaded shroud tubing 170 (e.g., a plurality of lengths of tubing threaded together to form a continuous shroud tubing). The length of shroud tubing 170 connected in series may depend on specific well conditions but could range from 20 ft. up to 500 ft. in tubing length. Adapters may be threaded on to the top and bottom of the shroud string to allow for threaded connection of a shroud base comprising the motor seat plate 190, shroud tubing 170, clamp 600 and/or shroud inlet 605. Before ESP assembly 100 is lowered, shroud tubing 170 may be lowered into well casing 105, shroud base comprising the motor seat plate 190 may be attached to the upstream end of shroud tubing 170, and shroud inlet 605 may be secured to the downstream end of shroud tubing 170. At this point the shroud tubing 170 string with shroud base 190 and shroud inlet 605 may be lowered into well casing 105 to the prescribed depth. Shroud assembly 150 may be held in place on slips as ESP assembly 100 is assembled.

In an example, the shroud assembly 150 may be progressively built and progressively lowered into the well casing 105 as additional shroud tubing 170 joints are added to a downstream end of the shroud assembly 150. After the shroud assembly 150 has been built, excluding coupling the clamp 600 to the shroud inlet 605, the motor 115, motor head 155, ESP intake 125, and centrifugal ESP pump 130 may be lowered into the shroud assembly 150. Joints of production tubing 140 may be added progressively to the ESP string and the ESP string progressively lowered into the shroud assembly 150 until the motor head 155 seats inside the motor seat plate 190. The ESP string is desirably rotated to align the motor head 155 with the motor seat plate 190. For example, as the shroud assembly 150 is built, a mark is traced on the outside of the shroud assembly 150 rotationally in line with the alignment mark 192. When the ESP string is lowered into the shroud assembly, a second mark is traced on the outside of the ESP string rotationally in line with the point of maximum offset of the motor head 155 (e.g., in line with the second through-hole 158 of the motor head 155). As the ESP string is lowered into the shroud assembly, the second mark is desirably kept line-up with the mark traced on the outside of the shroud assembly 150. Then, when the motor head 155 seats into the motor seat plate 190, the eccentric tapered surfaces 157, 192 should be aligned with each other to seat properly and to form a good contact (e.g., crush) seal.

The clamp 600 may then be attached to the shroud inlet 605 and to the production tubing 140. An ESP technician may attach clamp 600 to shroud inlet 605, for example by shear key 450, and bolt the two halves of clamp 600 (600*a*, 600*b*) tightly around production tubing 140, holding shroud assembly 150 in position. In an exemplary embodiment, clamp 600 may include rows of one-inch bolt holes 470. Bolt-holes 470 may be evenly distributed around clamp 600. In one example, clamp 600 may be secured by two columns and three rows of bolts 465 and washers perpendicular to the split. Bolts 465 may be secured into bolt-holes 470 to firmly attach clamp 600 to production tubing 140. Once the clamp 600 is in place, the entire shroud assembly 150 and ESP assembly 100 may be lowered into the ground under install procedures. Illustrative embodiments may be installed in about one day, as compared to two days installation time for conventional inverted shroud recirculation pump systems.

Because shroud assembly 150 may be attached to production tubing 140 at nearly any point along the tubing, illustrative embodiments may allow for a longer shroud assembly having a greater liquid volume that is thus better able to handle gas slugs (e.g., the increased liquid volume provides more time, a time buffer, for the gas from the gas slug to separate from the liquid and thereby avoid operating problems). The seal between shroud assembly 150 and ESP assembly 100 of illustrative embodiments may allow the operative portion of motor 115 to remain in the flow of cooling well fluid whilst still employing an inverted shroud, eliminating the need for a recirculation pump in high GLR/low volume applications making use of an inverted shroud.

Figure 11:
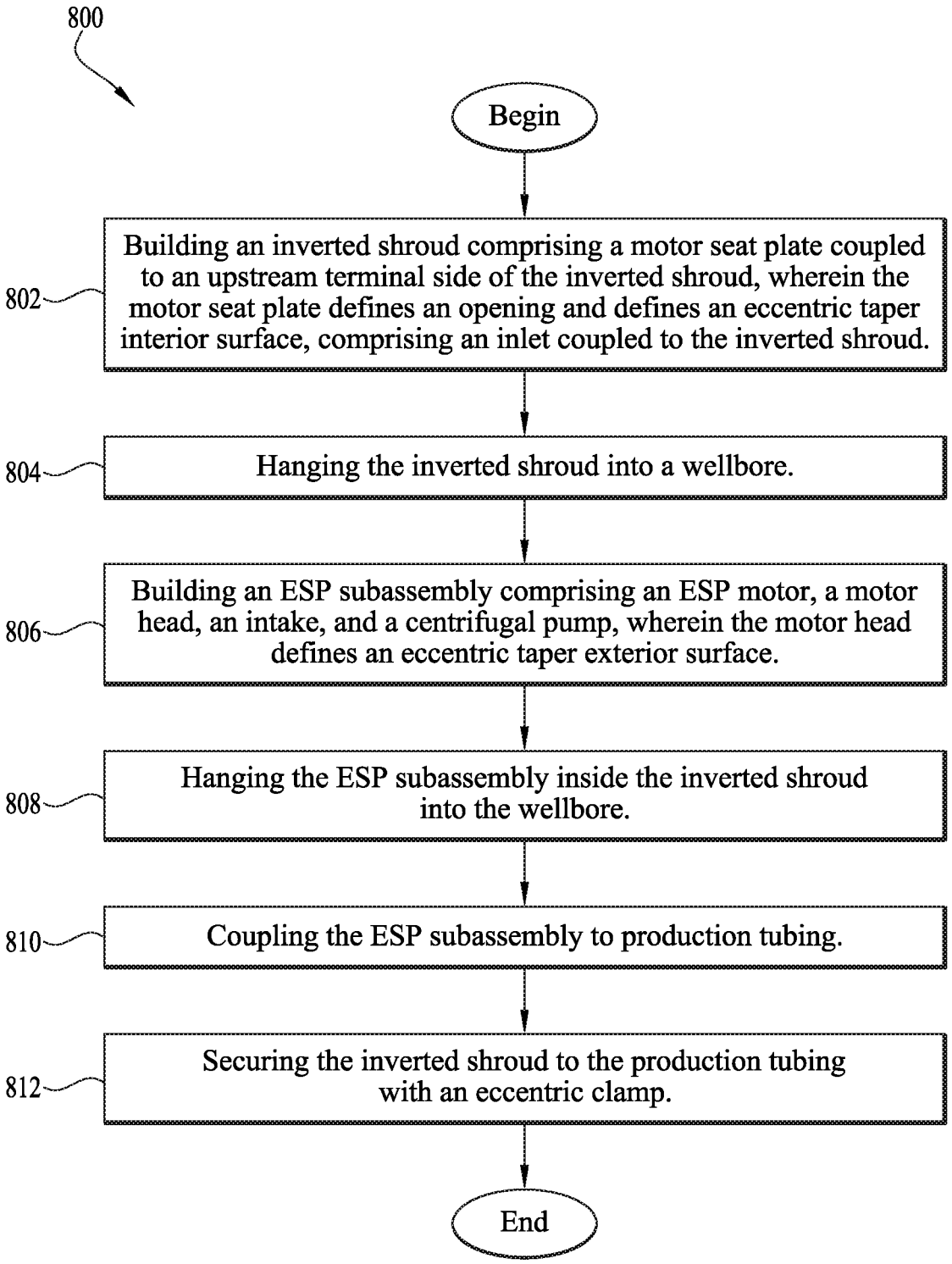
FIG. 11 is a flow chart of a method of building an electric submersible pump assembly according to embodiments of the disclosure.

Turning now to FIG. 11, a method 800 is described. In an embodiment, the method 800 is a method of building an electric submersible pump (ESP) assembly. At block 802, the method 800 comprises building an inverted shroud comprising a motor seat plate coupled to an upstream terminal side of the inverted shroud, wherein the motor seat plate defines an opening and defines an eccentric taper interior surface, comprising an inlet coupled to the inverted shroud. At block 804, the method 800 comprises hanging the inverted shroud into a wellbore (e.g., into the well casing 105).

It is understood that the processing of blocks 802 and 804 may be performed at substantially the same time. Said in other words, performing the actions of block 802 may involve connecting a plurality of joints of shroud tubing 170 and progressively lowering the in-progress shroud assembly 150 into the wellbore (e.g., into the well casing 105). The upper end of the shroud tubing 170 and/or the upper end of the under construction shroud assembly 150 may be held at the surface 185 or on a rig floor by slips. The next to the last component added to the shroud assembly 150 may be threading the shroud inlet 605 into a top-most joint of shroud tubing 170. As the inverted shroud is run into the wellbore (e.g., into the well casing 105), a worker may trace an alignment line on the outside of the shroud tubing 170 with a marker or scribe to maintain a visual prompt for aligning the point of maximum eccentricity of the motor seat plate 190 at the upstream end (e.g., downhole end) of the shroud assembly with the point of maximum eccentricity of the motor head 155 and/or the motor lead extension 220 when the motor 115, motor head 155, ESP intake 125, and centrifugal ESP pump 130 are run into the shroud assembly 150. The alignment mark 192 on the motor seat plate 190 may be used for starting the tracing of the alignment line on the outside of the shroud tubing 170.

At block 806, the method 800 comprises building an ESP subassembly comprising an ESP motor, a motor head, an intake, and a centrifugal pump, wherein the motor head defines an eccentric taper exterior surface. In an embodiment, some of the ESP subassembly may be pre-built or pre-assembled. At block 808, the method 800 comprises hanging the ESP subassembly inside the inverted shroud into the wellbore. The ESP subassembly is desirably rotated inside the shroud assembly 150 to align the motor lead extension 220 with the alignment line created while running the shroud assembly 150 into the wellbore. This will assure that the motor head 155 aligns properly with the motor seat plate 190 to form the crush seal between the eccentric tapered exterior surface 157 of the motor head 155 and the eccentric tapered interior surface 193 of the motor seat plate 190. This will also assure that the motor lead extension 220 has desired clearance between the interior of the shroud assembly 150 and the outside of the motor head 155, the ESP intake 125, and the centrifugal ESP pump 130.

At block 810, the method 800 comprises coupling the ESP subassembly to production tubing. The processing of block 810 may comprise adding a succession of joints of production tubing to the production tubing 140 leading to the ESP subassembly. At block 812, the method 800 comprises securing the inverted shroud to the production tubing with an eccentric clamp. The method 800 may further comprise continuing adding additional joints of production tubing to the ESP assembly and lowering it further and further into the wellbore (e.g., into the well casing 105) until the ESP assembly reaches a preferred completion depth in the wellbore.

Figure 12:
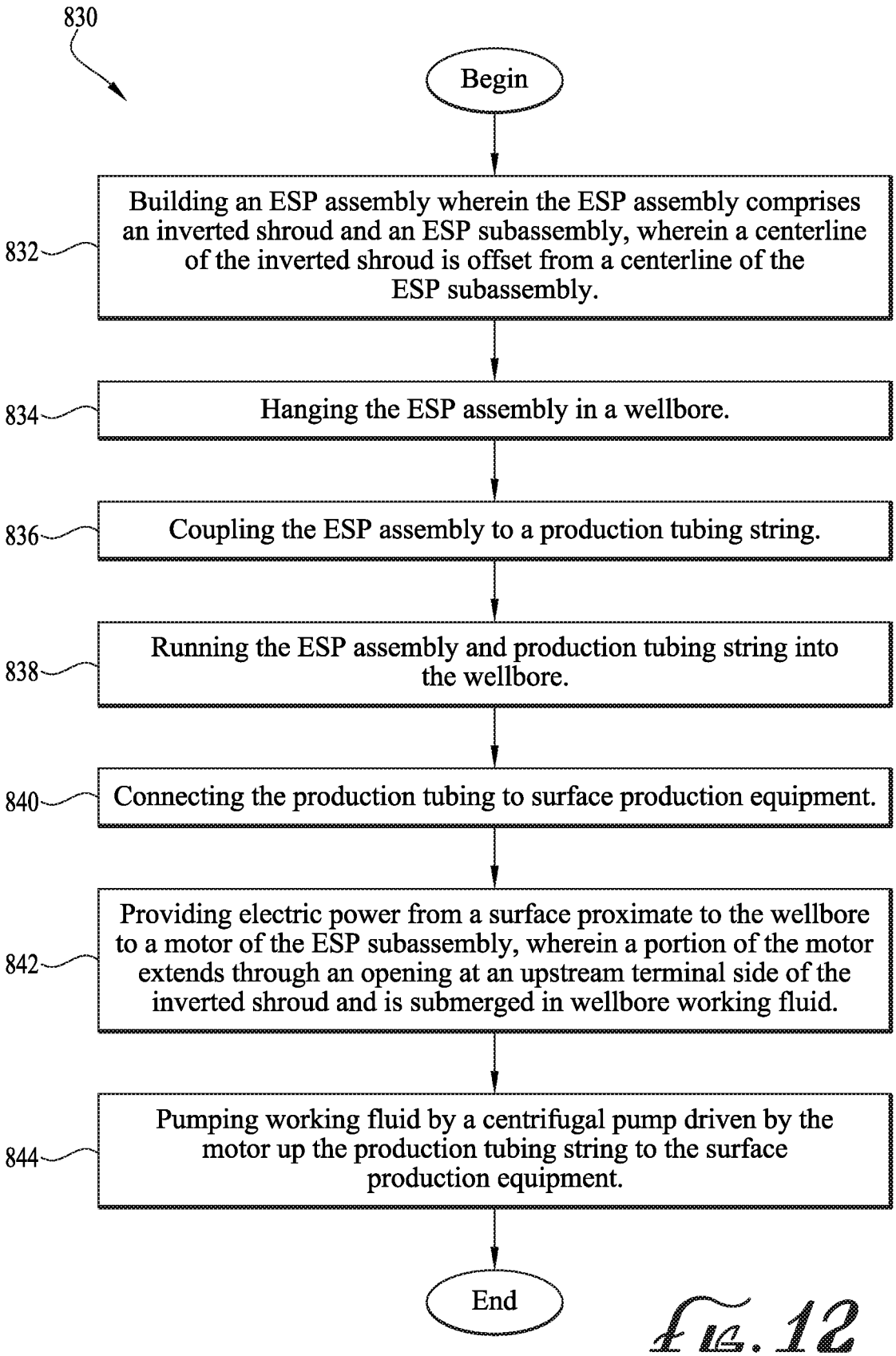
FIG. 12 is a flow chart of a method of producing hydrocarbons from a wellbore according to embodiments of the disclosure.

Turning now to FIG. 12, a method 830 is described. In an embodiment, the method 830 is a method of producing hydrocarbons from a wellbore. At block 832, the method 830 comprises building an ESP assembly wherein the ESP assembly comprises an inverted shroud and an ESP subassembly, wherein a centerline of the inverted shroud is offset from a centerline of the ESP subassembly.

At block 834, the method 830 comprises hanging the ESP assembly in a wellbore. At block 836, the method 830 comprises coupling the ESP assembly to a production tubing string.

At block 838, the method 830 comprises running the ESP assembly and production tubing string into the wellbore. At block 840, the method 830 comprises connecting the production tubing to surface production equipment.

At block 842, the method 830 comprises providing electric power from a surface proximate to the wellbore to a motor of the ESP subassembly, wherein a portion of the motor extends through an opening at an upstream terminal side of the inverted shroud and is submerged in wellbore formation fluid. At block 844, the method 830 comprises pumping formation fluid by a centrifugal pump driven by the motor up the production tubing string to the surface production equipment.

Figure 13A:
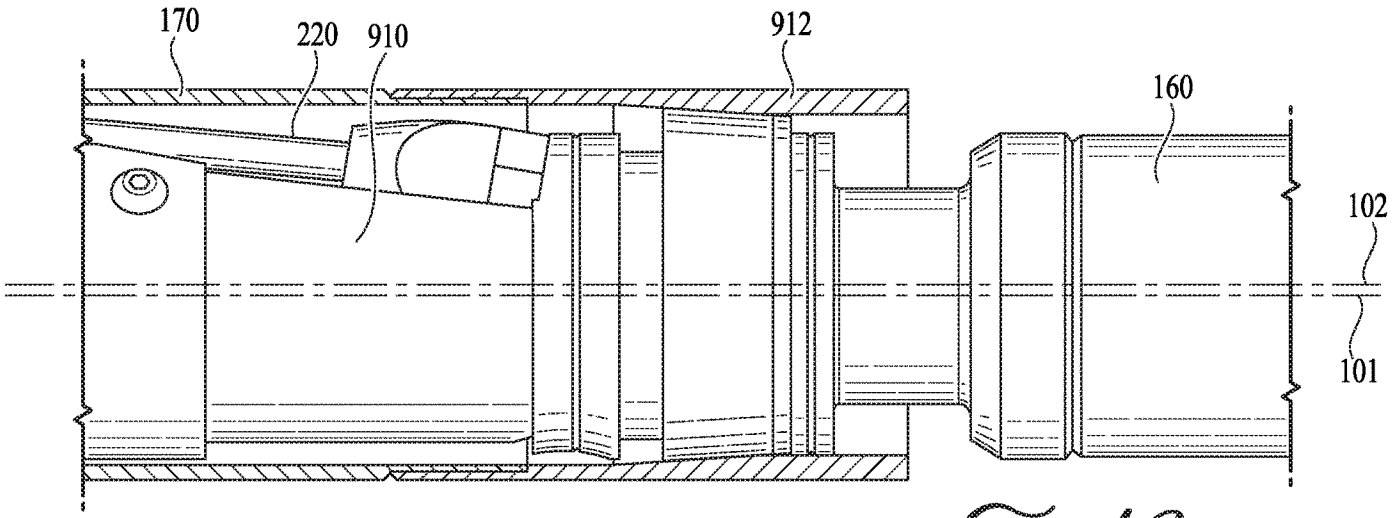
FIG. 13A and FIG. 13B are views of another motor head disposed in a symmetrical motor seat plate according to embodiments of the disclosure.
Figure 13B:
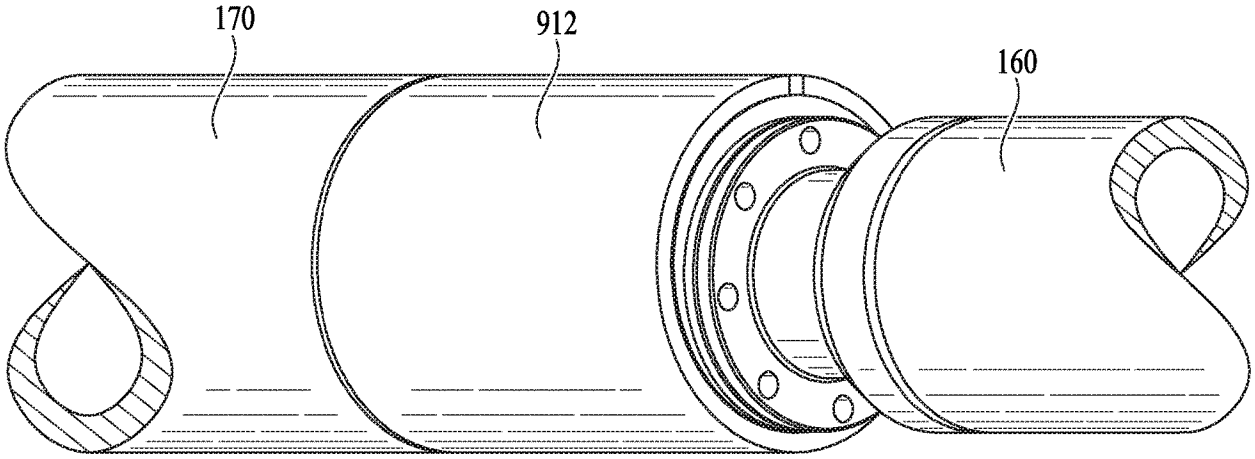

Turning now to FIG. 13A and FIG. 13B, another embodiment of a motor head and a motor seat plate suitable for use in the ESP assembly 100 with an eccentric inverted shroud is described. In an embodiment, the ESP assembly 100 comprises a motor head 910 coupled to the electric motor 160, where the motor head 910 seats into a motor seat plate 912. The motor seat plate 912 is coupled to the inverted shroud 170, for example welded to the inverted shroud 170 or threadingly coupled to the inverted shroud 170. As will be described further hereinafter, a rotationally symmetrical exterior surface of the motor head 910 is angled to mate with a rotationally symmetrical interior surface of the motor seat plate 912.

The motor head 910 is configured to establish an offset between the centerline 101 and the centerline 102. Said in other words, the motor head 910 is eccentric and establishes an eccentricity in the ESP assembly 100. The first centerline 101, established by the bolt holes and drive shaft through-hole of the motor head 910 (see through-hole 913 and bolt holes 914 in FIG. 14A) aligns with a centerline of the electric motor 160, a drive shaft (not shown) coupling the electric motor to the centrifugal pump 130, and the centrifugal pump 130; the second centerline 102 aligns with a centerline of an outside diameter of a downhole face (see motor head face 914 in FIG. 14A), a centerline of the motor seat plate 912, and the inverted shroud 170. This eccentricity of the motor head 910 provides additional space within the inverted shroud 170 to accommodate the motor lead extension 220. The motor head 910 is eccentric at least because the centerline of the bolt holes and drive shaft through-hole of the motor head 910 aligns with the first centerline 101 and the outside diameter of the downhole face of the motor head 910 aligns with the second centerline 102.

Figure 14A:
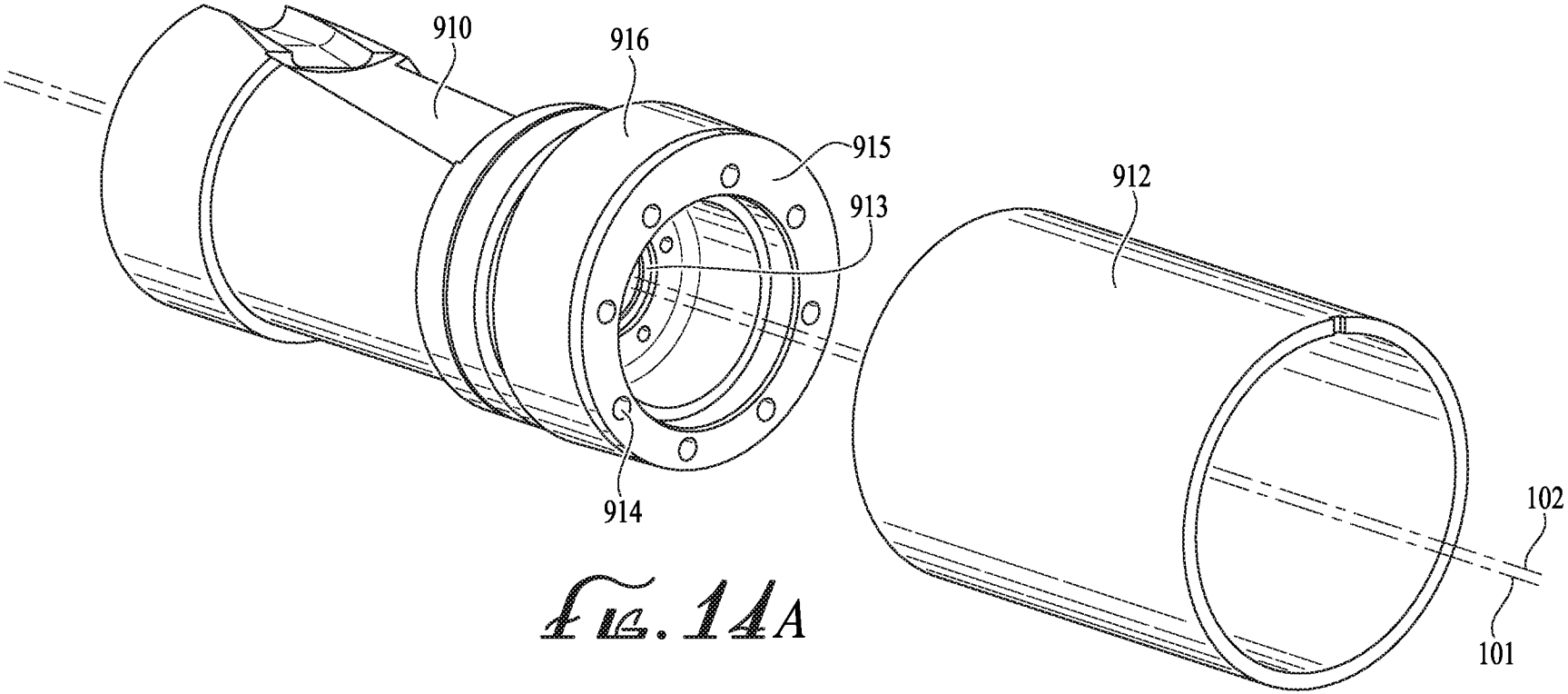
FIG. 14A, FIG. 14B, and FIG. 14C are views of the motor head and the symmetrical motor seat plate according to embodiments of the disclosure.

Turning now to FIG. 14A, further details of the motor head 910 and the motor seat plate 912 are described. The motor head 910 comprises a rotationally symmetrical exterior surface 916 that mates with a rotationally symmetrical inner surface of the motor seat plate 912 described below with reference to FIG. 14B and FIG. 14C. The motor head 910 defines a through-hole 913 that may receive the drive shaft that conveys torque from the electric motor 160 to the centrifugal pump 130. The motor head 910 also defines a plurality of bolt holes that may be used to couple the electric motor 160 to the motor head 910. A centerline of the through-hole 913 aligns with the centerline 101. A center of a circle intersecting the centers of the bolt holes 914 aligns with the centerline 101. The motor head 910 comprises a downhole face 915 that has an outside diameter that is aligned with the centerline 102 (i.e., a center of the outside diameter of the face 915 is on the centerline 102).

Figure 14B:
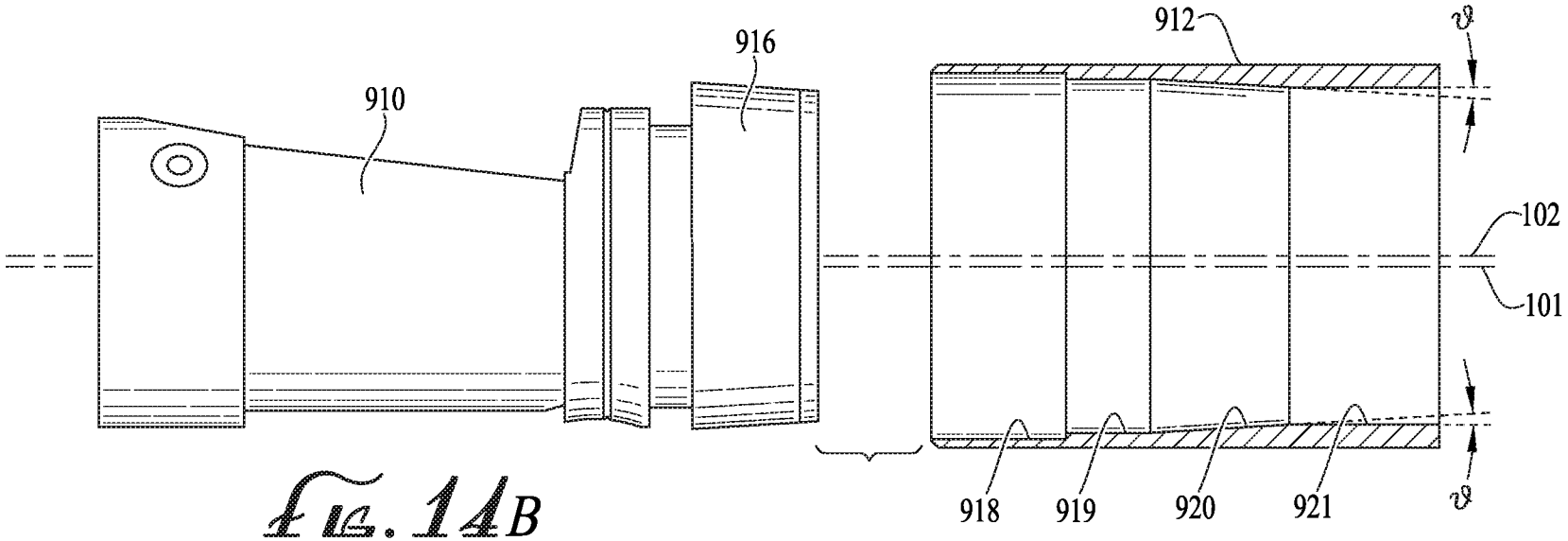

Turning now to FIG. 14B, further details of the motor head 910 and the motor seat plate 912 are described. The motor seat plate 912 defines a first interior surface 918, a second interior surface 919, a third interior surface 920, and a fourth interior surface 921. Each of the surfaces 918, 919, 920, 921 are rotationally symmetrical. The first interior surface 918 has a large enough diameter to accommodate the electric motor 160 and the motor head 910. The third interior surface 920 defines an angle $\vartheta$ relative to the centerline 102. In an embodiment, the angle $\vartheta$ is about 0.5 degrees, about 0.75 degrees, about 1.0 degrees, about 1.25 degrees, about 1.5 degrees, about 1.75 degrees, about 2.0 degrees, about 2.25 degrees, about 2.5 degrees, about 2.75 degrees, about 3.0 degrees, about 3.5 degrees, about 4.0 degrees, about 4.5 degrees, about 5 degrees, about 6 degrees, about 7 degrees, about 8 degrees, about 9 degrees, about 10 degrees, about 12 degrees, about 15 degrees, about 18 degrees, about 20 degrees, about 25 degrees, or another number of degrees.

Figure 14C:
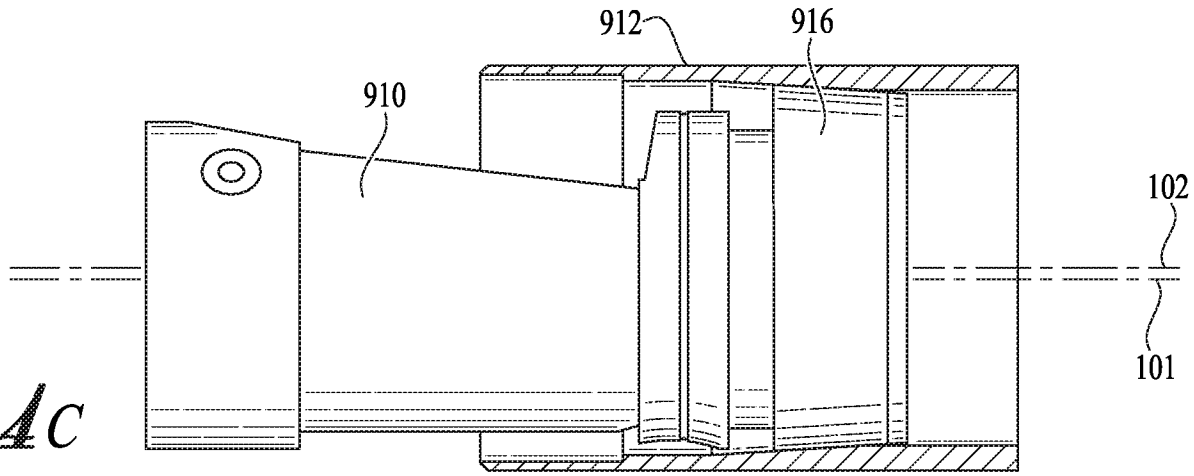

Turning now to FIG. 14C, the motor head 910 is illustrated seated in the motor seat plate 912 with the exterior surface 916 defined by the motor head 910 contacting the interior surface 920 defined by the motor seat plate 912.

Figure 15A:
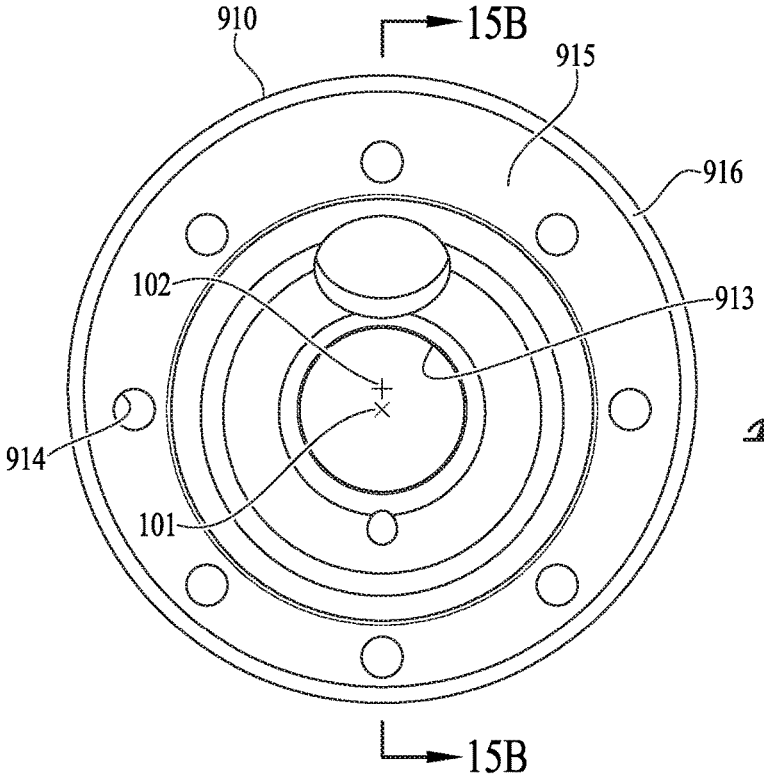
FIG. 15A and FIG. 15B are views of the motor head according to embodiments of the disclosure.
Figure 15B:
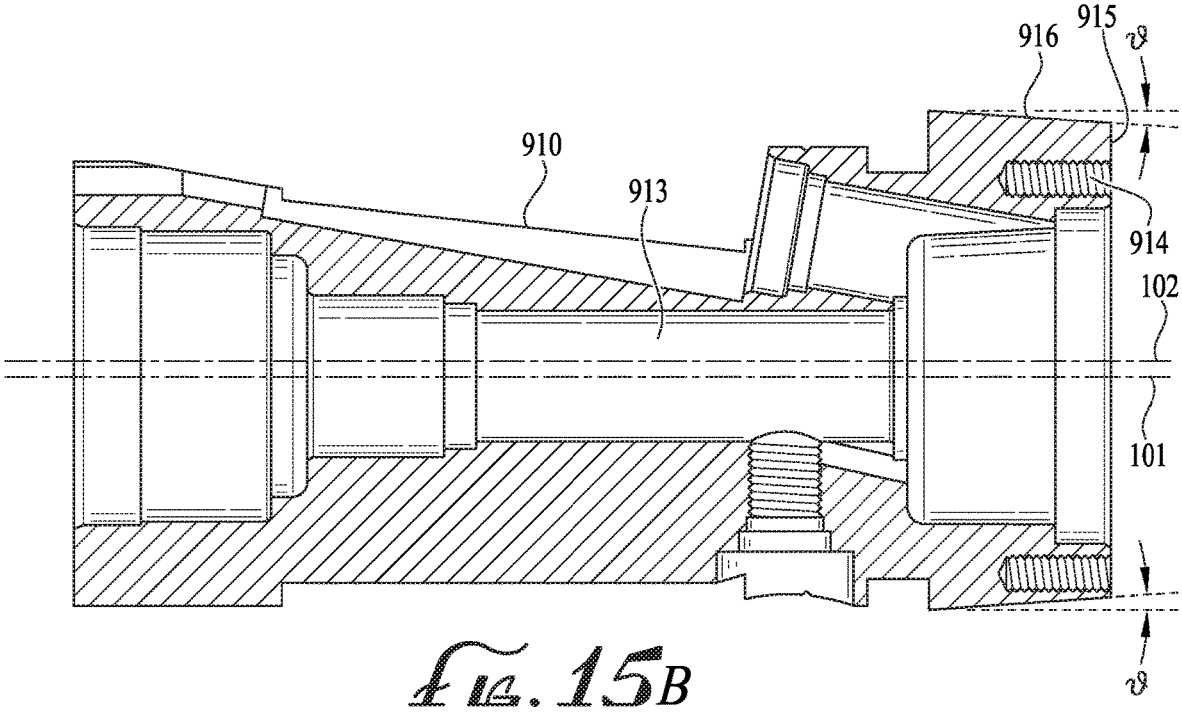

Turning now to FIG. 15A and FIG. 15B, further details of the motor head 910 are described. The exterior surface 916 defines an angle $\vartheta'$ that is equal to angle $\vartheta$ defined by the interior surface 920 defined by the motor seat plate 912. The exterior surface 916 and the interior surface 920 may be referred to as tapered surfaces, because of the angle $\vartheta$ defined by each surface with reference to the centerline 102. When the ESP assembly 100 is run into the inverted shroud 170, the exterior surface 916 mates with the interior surface 920 and wedge together to form a seal.

The alternative configuration of the ESP assembly 100 that includes the motor head 910 and the motor seat plate 912 provides the advantage that a precise rotational alignment between the motor head 910 and the motor seat plate 912 is not needed because the mating surfaces 916 and 920 are symmetrical. Additionally, the machining of the symmetrical surfaces 916, 920 is easier than the machining of the eccentric surfaces 157, 193 described above with reference to motor head 155 and motor seat plate 190. Additionally, the clamp 600 that secures the upper part of the inverted shroud to the production tubing 140 need not rotationally align with both the motor lead extension 220 and the motor head 157 but only with the motor lead extension 220. Thus, if the motor lead extension is not rotationally aligned with the second through-hole 158 (where the pothead of the motor lead extension 220 feeds through the motor head 157 to connect to the electric motor 160) this is not a problem with the motor head 910 and the motor seat plate 912.

An electric submersible pump (ESP) eccentric inverted shroud assembly has been described. Further modifications and alternative embodiments of various aspects of the several described embodiments, may be apparent to those skilled in the art in view of this description. Accordingly, this description is to be construed as illustrative only and is for the purpose of teaching those skilled in the art the general manner of carrying out or practicing the disclosed embodiments. It is to be understood that the forms of the embodiments of the ESP eccentric inverted shroud assembly shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description of the disclosure. Changes may be made in the elements described herein without departing from the scope and range of equivalents as described in the following claims. In addition, it is to be understood that features described herein independently may, in certain embodiments, be combined.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

ADDITIONAL DISCLOSURE

The following are non-limiting, specific embodiments in accordance with the present disclosure:

A first embodiment, which is an electric submersible pump (ESP) assembly comprising an inverted shroud separating a centrifugal ESP pump from a well casing, the ESP pump rotatably coupled to an ESP motor, the inverted shroud having an opening on an upstream terminal side, the upstream terminal side terminating at a head of the ESP motor, and at least a portion of the ESP motor extending through the opening and exposed to formation fluid, wherein the opening is sealed to the formation fluid at the head of the ESP motor and wherein a centerline of the inverted shroud is offset from a centerline of the ESP motor.

A second embodiment, which is the ESP assembly of the first embodiment, wherein the outside diameter of the shroud is less than about 4.5 inches.

A third embodiment, which is the ESP assembly of any of the first or the second embodiment, wherein the centerline of the inverted shroud is parallel with the centerline of the ESP motor.

A fourth embodiment, which is the ESP assembly of any of the first, the second, or the third embodiment, wherein the offset between the centerline of the inverted shroud and the centerline of the ESP motor is greater than about 0.06 inches and less than about 1 inch.

A fifth embodiment, which is the ESP assembly of any of the first, the second, the third, or the fourth embodiment, comprising a first taper around an outer surface of the head of the ESP motor and a second taper around an inner surface of the inverted shroud, the first and second tapers wedged together to form a seal.

A sixth embodiment, which is the ESP assembly of the fifth embodiment, wherein the first and second tapers are of equal angle.

A seventh embodiment, which is the ESP assembly of any of the fifth or the sixth embodiment, wherein the first and second tapers are eccentric.

An eighth embodiment, which is the ESP assembly of any of the fifth, the sixth, or the seventh embodiment, wherein the opening of the upstream terminal side of the inverted shroud is defined by a motor seat plate coupled to the upstream terminal side of the inverted shroud, wherein the motor seat plate defines the second taper around its inner surface and the motor seat plate defines an alignment mark aligned with a maximum offset of the motor seat plate.

A ninth embodiment, which is the ESP assembly of any of the fifth or the sixth embodiment, wherein the first and second tapers are symmetric.

A tenth embodiment, which is the ESP assembly of any of the first, the second, the third, the fourth, the fifth, the sixth, the seventh, the eighth, or the ninth embodiment, comprising a clamp securing the inverted shroud to a production tubing.

An eleventh embodiment, which is the ESP assembly of the tenth embodiment, wherein the clamp is eccentric.

A twelfth embodiment, which is the ESP assembly of any of the tenth or the eleventh embodiment, wherein the clamp defines a pathway for a motor lead extension.

A thirteenth embodiment, which is the ESP assembly of any of the first, the second, the third, the fourth, the fifth, the sixth, the seventh, the eighth, the ninth, the tenth, the eleventh, or the twelfth embodiment, comprising an inlet comprising a plurality of apertures, wherein the inlet is coupled to the inverted shroud.

A fourteenth embodiment, which is the ESP assembly of the thirteenth embodiment, wherein the inlet comprises at least one keyway aperture pair, wherein keyway apertures of the keyway aperture pair are located about 180 degrees angularly displaced to each other around the inlet.

A fifteenth embodiment, which is the ESP assembly of the fourteenth embodiment, wherein the inlet comprises a first keyway aperture pair, a second keyway aperture pair, and a third key way aperture pair, wherein the second keyway aperture pair is located 60 degrees angularly displaced to the first keyway aperture pair, and the third keyway aperture pair is located about 120 degrees angularly displaced to the first keyway aperture pair and about 60 degrees angularly displaced to the second keyway aperture pair.

A sixteenth embodiment, which is the ESP assembly of the fifteenth embodiment, wherein the second keyway aperture pair is displaced longitudinally in a first direction from the first keyway aperture pair and the third keyway aperture pair is displaced longitudinally in the first direction from the second keyway aperture pair.

A seventeenth embodiment, which is the ESP assembly of any of the fourteenth, the fifteenth, or the sixteenth embodiment, wherein the clamp is coupled to the inlet by at least one pair of shear keys, wherein each shear key is located in a keyway aperture and attached to the clamp.

An eighteenth embodiment, which is the ESP assembly of any of the first, the second, or the third embodiment, wherein the offset between the centerline of the inverted shroud and the centerline of the ESP motor is greater than about 0.08 inches and less than about 0.5 inch.

A nineteenth embodiment, which is a method of building an electric submersible pump (ESP) assembly, comprising building an inverted shroud comprising a motor seat plate coupled to an upstream terminal side of the inverted shroud, wherein the motor seat plate defines an opening and defines an eccentric taper interior surface, comprising an inlet coupled to the inverted shroud, hanging the inverted shroud into a wellbore, building an ESP subassembly comprising an ESP motor, a motor head, an intake, and a centrifugal pump, wherein the motor head defines an eccentric taper exterior surface, hanging the ESP subassembly inside the inverted shroud into the wellbore, coupling the ESP subassembly to production tubing, and securing the inverted shroud to the production tubing with an eccentric clamp.

A twentieth embodiment, which is a method of producing hydrocarbons from a wellbore, comprising building an ESP assembly wherein the ESP assembly comprises an inverted shroud and an ESP subassembly, wherein a centerline of the inverted shroud is offset from a centerline of the ESP subassembly, hanging the ESP assembly in a wellbore, coupling the ESP assembly to a production tubing string, running the ESP assembly and production tubing string into the wellbore, connecting the production tubing to surface production equipment, providing electric power from a surface proximate to the wellbore to a motor of the ESP subassembly, wherein a portion of the motor extends through an opening at an upstream terminal side of the inverted shroud and is submerged in wellbore formation fluid, and pumping formation fluid by a centrifugal pump driven by the motor up the production tubing string to the surface production equipment.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly comprising:

an inverted shroud separating a centrifugal ESP pump from a well casing and coupled to a production tubing, the ESP pump rotatably coupled to an ESP motor and wherein a centerline of the centrifugal ESP pump is aligned with a centerline of the ESP motor and with a centerline of the production tubing;

the inverted shroud having an opening on an upstream terminal side, the upstream terminal side terminating at a head of the ESP motor; and at least a portion of the ESP motor extending through the opening and exposed to formation fluid;

wherein the opening is sealed to the formation fluid at the head of the ESP motor and wherein a centerline of the inverted shroud is offset from the centerline of the ESP motor, the centerline of the centrifugal ESP pump, and the centerline of the production tubing.

2. The ESP assembly of claim 1, wherein the outside diameter of the shroud is less than about 4.5 inches.

3. The ESP assembly of claim 1, wherein the centerline of the inverted shroud is parallel with the centerline of the ESP motor.

4. The ESP assembly of claim 1, wherein the offset between the centerline of the inverted shroud and the centerline of the ESP motor is greater than about 0.06 inches and less than about 1 inch.

5. The ESP assembly of claim 1, comprising a first taper around an outer surface of the head of the ESP motor and a second taper around an inner surface of the inverted shroud, the first and second tapers wedged together to form a seal.

6. The ESP assembly of claim 5, wherein the first and second tapers are of equal angle.

7. The ESP assembly of claim 5, wherein the first and second tapers are eccentric.

8. The ESP assembly of claim 5, wherein the opening of the upstream terminal side of the inverted shroud is defined by a motor seat plate coupled to the upstream terminal side of the inverted shroud, wherein the motor seat plate defines the second taper around its inner surface and the motor seat plate defines an alignment mark aligned with a maximum offset of the motor seat plate.

9. The ESP assembly of claim 5, wherein the first and second tapers are symmetric.

10. The ESP assembly of claim 1, comprising a clamp securing the inverted shroud to a production tubing.

11. The ESP assembly of claim 10, wherein the clamp defines a through-hole that grips the outside of the production tubing, wherein a centerline of the through-hole is coincident with the centerline of the ESP motor, and wherein an outside diameter of the clamp has a centerline that is coincident with the centerline of the inverted shroud.

12. The ESP assembly of claim 10, wherein the clamp defines a pathway for a motor lead extension.

13. The ESP assembly of claim 1, comprising an inlet comprising a plurality of apertures, wherein the inlet is coupled to the inverted shroud.

14. The ESP assembly of claim 13, wherein the inlet comprises at least one keyway aperture pair, wherein keyway apertures of the keyway aperture pair are located about 180 degrees angularly displaced to each other around the inlet.

15. The ESP assembly of claim 14, wherein the inlet comprises a first keyway aperture pair, a second keyway aperture pair, and a third key way aperture pair, wherein the second keyway aperture pair is located 60 degrees angularly displaced to the first keyway aperture pair, and the third keyway aperture pair is located about 120 degrees angularly displaced to the first keyway aperture pair and about 60 degrees angularly displaced to the second keyway aperture pair.

16. The ESP assembly of claim 15, wherein the second keyway aperture pair is displaced longitudinally in a first direction from the first keyway aperture pair and the third keyway aperture pair is displaced longitudinally in the first direction from the second keyway aperture pair.

17. The ESP assembly of claim 14, wherein the clamp is coupled to the inlet by at least one pair of shear keys, wherein each shear key is located in a keyway aperture and attached to the clamp.

18. The ESP assembly of claim 1, wherein the offset between the centerline of the inverted shroud and the centerline of the ESP motor is greater than about 0.08 inches and less than about 0.5 inch.

19. A method of building an electric submersible pump (ESP) assembly, comprising:

building an inverted shroud comprising a motor seat plate coupled to an upstream terminal side of the inverted shroud, wherein the motor seat plate defines an opening and defines an eccentric taper interior surface wherein a first inside diameter of the motor seat plate defines a first centerline and a second inside diameter of the motor seat plate defines a second centerline offset from the first centerline, comprising an inlet coupled to the inverted shroud;

hanging the inverted shroud into a wellbore;

building an ESP subassembly comprising an ESP motor, a motor head, an intake, and a centrifugal pump, wherein the motor head defines an eccentric taper exterior surface wherein an exterior surface of the motor head at a first point has a third centerline that is coincident with the second centerline of the motor seat plate and a through-hole defined by the motor head has a fourth centerline that is coincident with the first centerline of the motor seat plate;

hanging the ESP subassembly inside the inverted shroud into the wellbore;

coupling the ESP subassembly to production tubing; and securing the inverted shroud to the production tubing with an eccentric clamp.

20. A method of producing hydrocarbons from a wellbore, comprising:

building an electric submersible pump (ESP) assembly wherein the ESP assembly comprises an inverted shroud and an ESP subassembly, wherein a centerline of the inverted shroud is offset from a centerline of the ESP subassembly and from a centerline of a production tubing, wherein the centerline of the production tubing is coincident with the centerline of the ESP subassembly;

hanging the ESP assembly in a wellbore;

coupling the ESP assembly to a production tubing string;

running the ESP assembly and production tubing string into the wellbore;

connecting the production tubing to surface production equipment;

providing electric power from a surface proximate to the wellbore to a motor of the ESP subassembly, wherein a portion of the motor extends through an opening at an upstream terminal side of the inverted shroud and is submerged in wellbore formation fluid; and pumping formation fluid by a centrifugal pump of the ESP subassembly, driven by the motor, up the production tubing string to the surface production equipment.

* * * * *